US011054182B2

(12) United States Patent
Zhao et al.

(10) Patent No.: US 11,054,182 B2
(45) Date of Patent: Jul. 6, 2021

(54) PROCESS AND APPARATUS FOR SEPARATING AIR USING A SPLIT HEAT EXCHANGER

(71) Applicant: Air Products and Chemicals, Inc., Allentown, PA (US)

(72) Inventors: Qiao Zhao, Macungie, PA (US); Donn Michael Herron, Fogelsville, PA (US)

(73) Assignee: Air Products and Chemicals, Inc., Allentown, PA (US)

( * ) Notice: Subject to any disclaimer, the term of this patent is extended or adjusted under 35 U.S.C. 154(b) by 12 days.

(21) Appl. No.: 15/993,993

(22) Filed: May 31, 2018

(65) Prior Publication Data

US 2019/0368811 A1 Dec. 5, 2019

(51) Int. Cl.
*F25J 3/04* (2006.01)

(52) U.S. Cl.
CPC ..... *F25J 3/04709* (2013.01); *F25J 3/0409* (2013.01); *F25J 3/04084* (2013.01); *F25J 3/04303* (2013.01); *F25J 3/04872* (2013.01); *F25J 2200/32* (2013.01); *F25J 2200/34* (2013.01); *F25J 2200/50* (2013.01); *F25J 2200/90* (2013.01); *F25J 2250/40* (2013.01); *F25J 2250/50* (2013.01)

(58) Field of Classification Search
CPC .. F25J 3/04412; F25J 3/04418; F25J 3/04218; F25J 3/0423; F25J 3/0409; F25J 3/04315; F25J 3/0496; F25J 3/04309; F25J 2200/50
See application file for complete search history.

(56) References Cited

U.S. PATENT DOCUMENTS 3,086,371 A 4/1963 Schilling et al.
4,133,662 A * 1/1979 Wagner ..... F25J 3/0409 62/650
4,254,629 A * 3/1981 Olszewski ..... F25J 3/04193 62/651
4,400,188 A 8/1983 Patel et al.
4,555,256 A 11/1985 Skolaude et al.
5,092,132 A * 3/1992 Marshall ..... F25J 3/0409 62/646
5,341,646 A * 8/1994 Agrawal ..... F25J 3/0409 62/646
5,355,682 A 10/1994 Agrawal et al.
(Continued)

FOREIGN PATENT DOCUMENTS

EP 1767884 A1 3/2007
EP 2924407 A1 1/2015
(Continued)

OTHER PUBLICATIONS

EPO Search Report (EP19177393) dated Jan. 30, 2020, 13 pgs.

*Primary Examiner* — David J Teitelbaum
*Assistant Examiner* — Jason N Thompson
(74) *Attorney, Agent, or Firm* — Matthew R. Weaver

(57) ABSTRACT

Process and apparatus for the separation of a compressed feed air stream to produce an oxygen product using a distillation column having a lower-pressure column and a higher-pressure column, a higher-pressure heat exchanger and a lower-pressure heat exchanger where the gaseous nitrogen expander receives a nitrogen-enriched fraction from a position intermediate the warmer end and the colder end of the higher-pressure heat exchanger.

8 Claims, 12 Drawing Sheets

(56) References Cited

U.S. PATENT DOCUMENTS

| | | | | |
|---|---|---|---|---|
| 5,934,104 | A * | 8/1999 | Fidkowski | F25J 3/04224 62/643 |
| 5,956,974 | A | 9/1999 | Agrawal et al. | |
| 6,233,970 | B1 | 5/2001 | Smith, IV et al. | |
| 2005/0126221 | A1 | 6/2005 | Ha et al. | |
| 2006/0169000 | A1 | 8/2006 | Judas | |
| 2011/0214453 | A1 | 9/2011 | Alekseev | |
| 2016/0231053 | A1 | 8/2016 | Asse et al. | |
| 2017/0211879 | A1 * | 7/2017 | Igra | F25J 3/04884 |

FOREIGN PATENT DOCUMENTS

| | | | |
|---|---|---|---|
| FR | 1439066 | A | 5/1966 |
| FR | 2711778 | A | 5/1995 |
| FR | 2778971 | | 11/1999 |

* cited by examiner

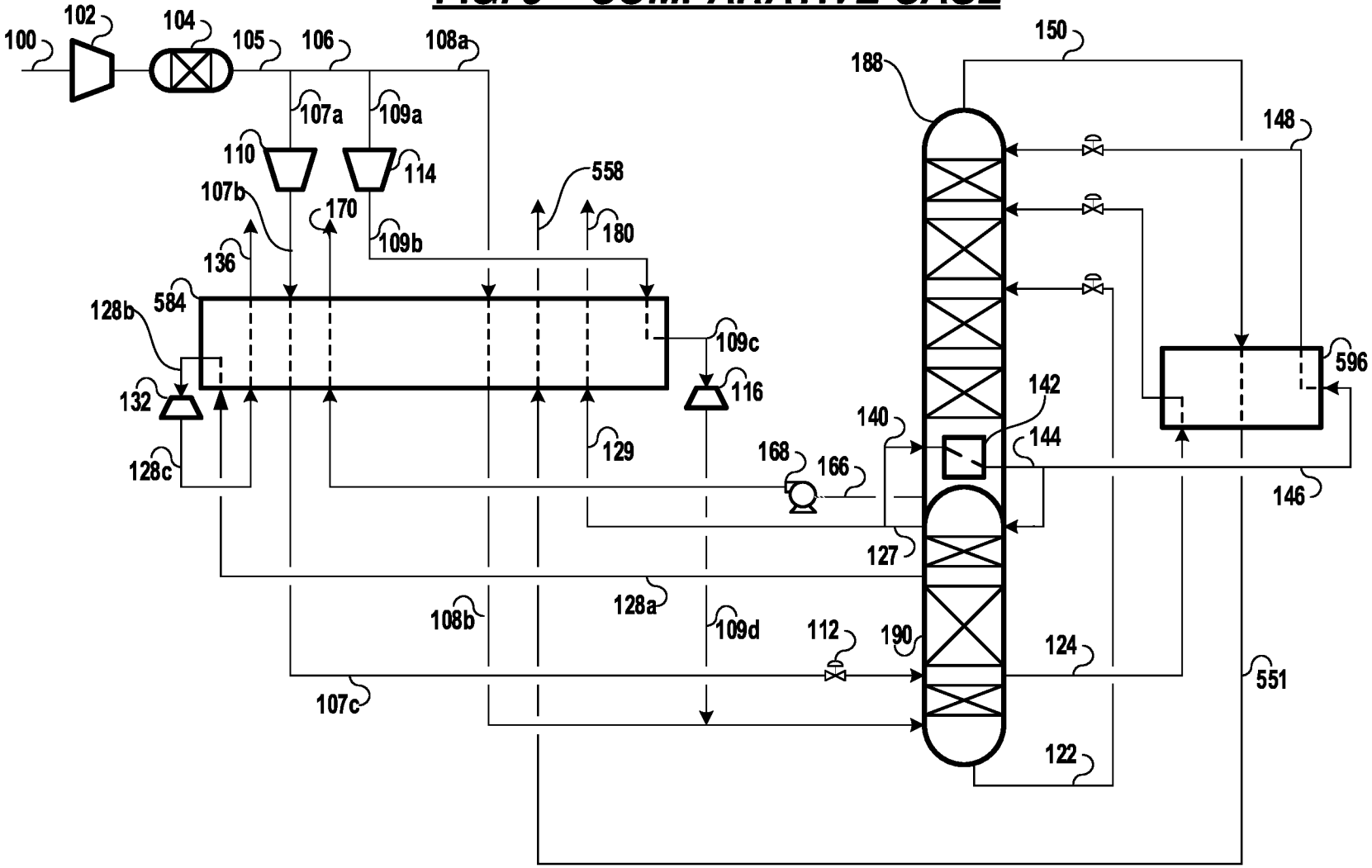
FIG. 5 – COMPARATIVE CASE

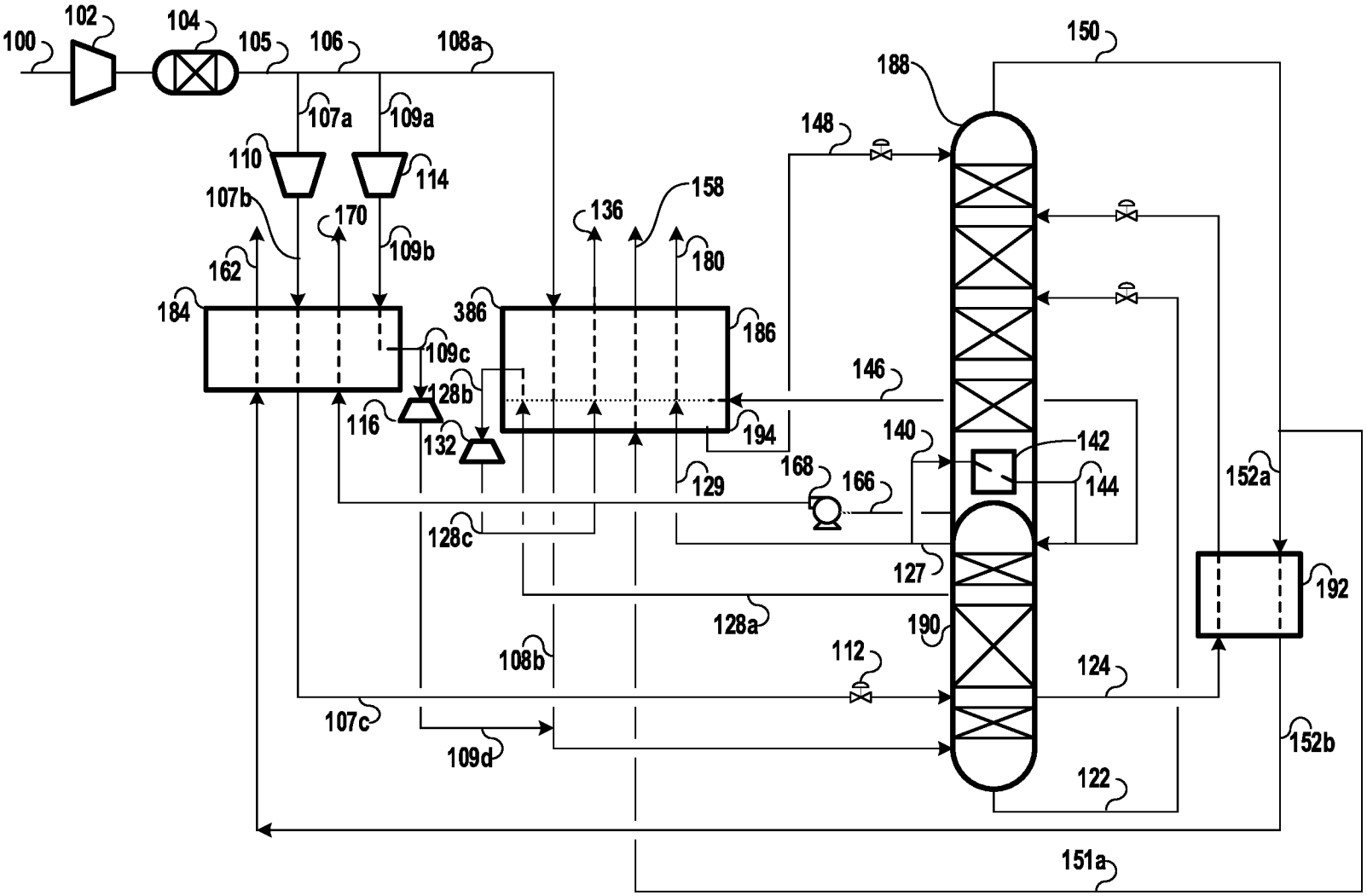
FIG. 6 – PRIOR ART

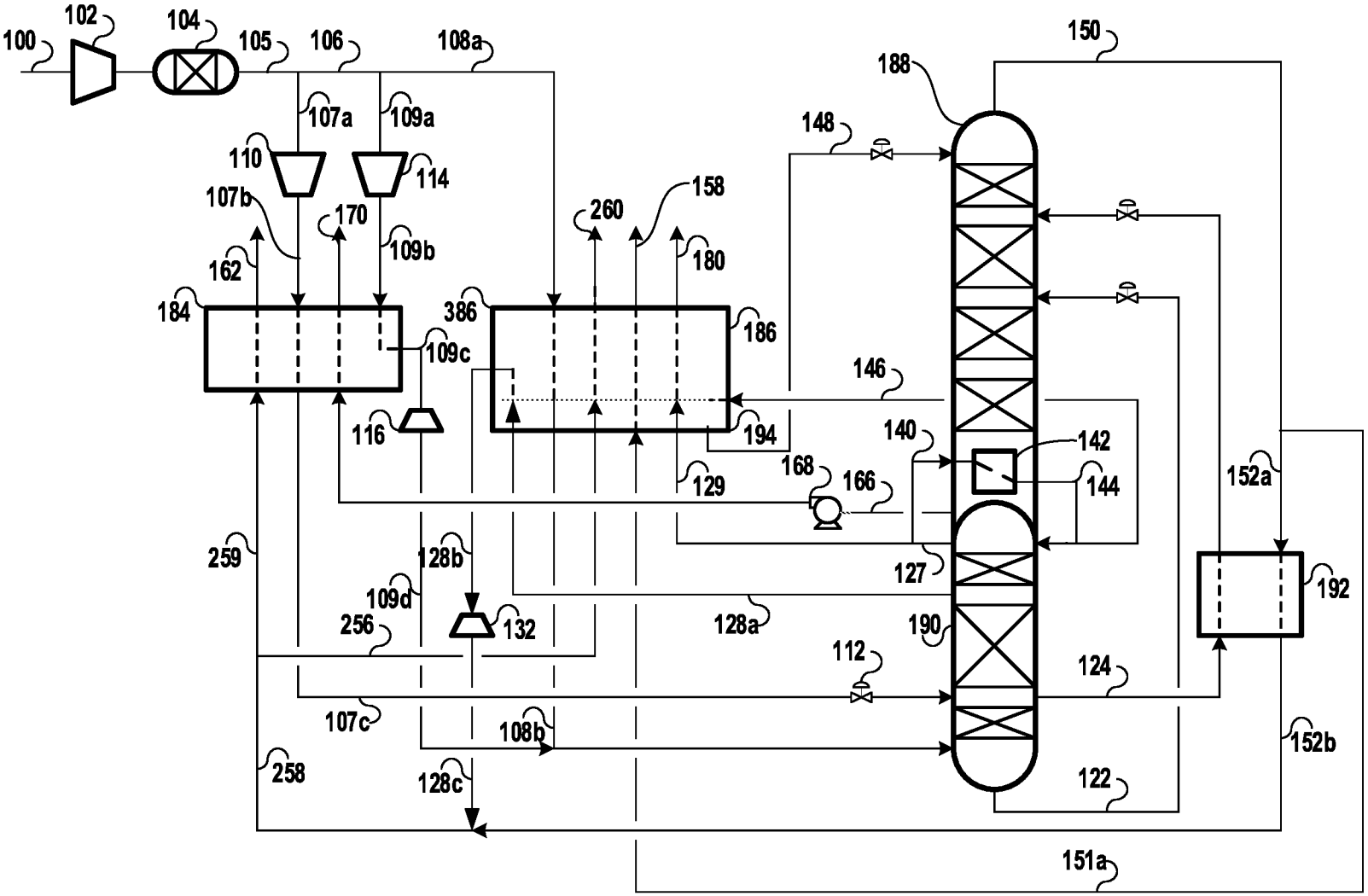
FIG. 7 – COMPARATIVE CASE

PROCESS AND APPARATUS FOR SEPARATING AIR USING A SPLIT HEAT EXCHANGER

BACKGROUND

The present disclosure relates generally to a process and apparatus for the separation of air to produce an oxygen product, and optionally a nitrogen product and/or argon product. More specifically, the present disclosure relates to a process and apparatus for the separation of air to produce an oxygen product, and optionally a nitrogen product and/or argon product using an improved heat exchange process and apparatus.

A well-known cryogenic process for the production of both oxygen and nitrogen is the double-column cycle. The double-column cycle process uses a distillation column system having a higher-pressure column, a lower-pressure column, and a reboiler-condenser, which thermally links the higher-pressure column to the lower-pressure column. Early versions of the double-column cycle produced both nitrogen and oxygen as vapors from the lower pressure column. More recently, it has become commonplace to withdraw the oxygen product from the distillation column system as a liquid, raise the pressure of the liquid oxygen by using either static head or a pump, and vaporize the oxygen in a main heat exchanger system, for example, by cooling and liquefying a compressed feed air stream. This technique for producing pressurized oxygen is often referred to as "internal oxygen compression" or "pumped-LOX" and is discussed in the literature.

Refrigeration is required in an air separation plant to compensate for heat leak around the plant and the production of liquid products such as liquid oxygen, liquid nitrogen, and liquid argon. Refrigeration can be provided by compressing, cooling and expanding part of the feed air using an air expander. This feed air stream is typically cooled in the main heat exchanger system to an intermediate temperature before sending the feed air stream to the expander. Refrigeration can also be provided by expanding a nitrogen-enriched vapor stream from the higher-pressure column. This nitrogen-enriched stream is warmed to an intermediate temperature in the main heat exchanger system and sent to a gaseous nitrogen (GAN) expander. The discharge from the GAN expander is then warmed to substantially ambient temperature in the main heat exchanger system.

It is known in the art that the most efficient way to transfer heat between the various warmer streams and various colder streams is to exchange heat between the streams in a single heat exchanger. In this way, each warmer stream can transfer heat to multiple colder streams at the same time. This practice is facilitated through the use of plate-fin heat exchangers, which can accommodate any number of streams.

However, as the total number of streams in the single heat exchanger becomes too great, it becomes advantageous, from a capital point of view, to carry-out the heat transfer in two or more heat exchangers in parallel. When this is done, the designer needs to decide which of the process streams to pass through which heat exchanger. The objective is to match the thermal performance of the multi-exchanger system to that of the single heat exchanger.

When using the pumped-LOX technique, it is common to split the main heat exchanger system into two parallel heat exchangers. These two heat exchangers are often called the high-pressure heat exchanger and the low-pressure heat exchanger. The high-pressure heat exchanger, as the name implies, contains some key higher-pressure streams, namely the boiling/warming oxygen fluid and the cooling/condensing pressurized air stream. One or more lower-pressure gas streams may also pass through the high-pressure heat exchanger for thermal balancing. The low-pressure heat exchanger cools the medium pressure air feed and warms various lower-pressure gas streams. Depending on cost and thermal efficiency, any remaining lower pressure streams can be distributed between the high-pressure and the low-pressure heat exchanger as desired. A split main heat exchanger design is disclosed in U.S. Pat. No. 4,555,256, incorporated herein by reference to the extent that the disclosure therein does not conflict with the teachings of the present application.

Several liquid streams are required to be sent from the higher-pressure column to the lower-pressure column. These streams include a liquid oxygen-enriched stream from the bottom, a liquid nitrogen-rich stream from the top, and a column side-stream liquid which is less-oxygen enriched than the columns bottoms. Due to the large pressure difference between the higher- and lower-pressure columns, it is well-known in the art to employ one or more subcoolers to subcool one or more of these liquid streams to improve overall efficiency by reducing flash losses from pressure reduction. The cooling is typically provided by heat exchange with one or more portions of a lower-pressure nitrogen-rich gas stream produced from the upper region of the lower-pressure column. The subcooler can also be divided into two separate subcoolers, and they can either be standalone heat exchangers, or integrated as part of the higher-pressure or the lower-pressure heat exchanger.

The selection of streams passed to either the higher- and lower-pressure heat exchangers can significantly impact the efficiency of the overall process and has been an active area of research in the art. A common method disclosed in the literature for thermally balancing the streams between the lower-pressure and higher-pressure heat exchangers is to split a low-pressure nitrogen-rich gas stream between the two heat exchangers. This low-pressure nitrogen-rich stream is typically a nitrogen-rich gas stream withdrawn from an upper region of the lower-pressure column, such as the so-called waste stream or the low-pressure nitrogen product stream.

Other related disclosures include FR2778971 and EP2824407, each incorporated herein by reference to the extent that the disclosure therein does not conflict with the teachings of the present application.

Industry desires to improve the efficiency of oxygen production processes from a cryogenic separation plant using a GAN expander, a split main heat exchanger system, and a split subcooler configuration.

BRIEF SUMMARY

The present disclosure relates to the separation of a compressed feed air stream to produce an oxygen product, and optionally nitrogen and/or argon products.

There are several aspects of the invention as outlined below. In the following, specific aspects of the invention are outlined. The reference numbers and expressions set in parentheses are referring to an example embodiment explained further below with reference to the figures. The reference numbers and expressions are, however, only illustrative and do not limit the aspect to any specific component or feature of the example embodiment. The aspects can be formulated as claims in which the reference numbers and expressions set in parentheses are omitted or replaced by others as appropriate.

Aspect 1. A process for the separation of a compressed feed air stream (105) to produce an oxygen product (170) and optionally a nitrogen product (180), the process comprising:

providing a multi-column distillation system comprising a lower-pressure column (188) and a higher-pressure column (190);

passing a first portion (107*b*) of the compressed feed air stream (105) into a first (warmer) end of a first heat exchanger section (184), cooling the first portion (107*b*) of the compressed feed air stream in the first heat exchanger section (184), and withdrawing the first portion (107*c*) of the compressed feed air stream from a second (colder) end of the first heat exchanger section (184);

passing the first portion (107*c*) of the compressed feed air stream (105) withdrawn from the second (colder) end of the first heat exchanger section (184) to at least one of the higher-pressure column (190) or the lower-pressure column (188);

passing a second portion (108*a*) of the compressed feed air stream (105) into a first (warmer) end of a second heat exchanger section (186), cooling the second portion (108*a*) of the compressed feed air stream in the second heat exchanger section (186), and withdrawing the second portion (108*b*) from a second (colder) end of the second heat exchanger section (186);

passing the second portion (108*b*) of the compressed feed air stream withdrawn from the second (colder) end of the second heat exchanger section (186) to the higher-pressure column (190);

withdrawing an oxygen-enriched fraction (122) from the higher-pressure column (190);

passing the oxygen-enriched fraction (122) withdrawn from the higher-pressure column (190) to the lower-pressure column (188);

withdrawing an oxygen-rich fraction (166) from the lower-pressure column (188);

passing the oxygen-rich fraction (166) withdrawn from the lower-pressure column (188) to the second (colder) end of the first heat exchanger section (184), heating the oxygen-rich fraction (166) in the first heat exchanger section (184), and withdrawing the oxygen-rich fraction (166) from the first (warmer) end of the first heat exchanger section (184) as the oxygen product (170);

withdrawing a nitrogen-enriched fraction (128*a*) from the higher-pressure column (190);

passing the nitrogen-enriched fraction (128*a*) withdrawn from the higher-pressure column (190) to the second (colder) end of the first heat exchanger section (184), heating the nitrogen-enriched fraction (128*a*) in the first heat exchanger section (184), and withdrawing the nitrogen-enriched fraction (128*b*) from a position intermediate the first (warmer) end and the second (colder) end of the first heat exchanger section (184); and expanding the nitrogen-enriched fraction (128*b*) withdrawn from the position intermediate the first (warmer) end and the second (colder) end of the first heat exchanger section (184) in an expander (132) to produce work and reduce the pressure of the nitrogen-enriched fraction (128*c*).

Aspect 2. The process according to aspect 1 wherein the pressure of the second portion (108*a*) of the compressed feed air stream (105) is less than the pressure of the first portion (107*b*) of the compressed feed air stream (105).

Aspect 3. The process according to aspect 1 or aspect 2 wherein a higher-pressure heat exchanger comprises the first heat exchanger section (184); and wherein a lower-pressure heat exchanger comprises the second heat exchanger section (186), wherein the maximum operating pressure in the lower-pressure heat exchanger is lower than the maximum operating pressure in the higher-pressure heat exchanger.

Aspect 4. The process according to any one of aspects 1 to 3 further comprising:

passing the expanded nitrogen-enriched fraction (128*c*) or a first portion (128*e*) thereof to the second (colder) end of the second heat exchanger section (186), heating the expanded nitrogen-enriched fraction (128*c*) or the first portion thereof (128*e*) in the second heat exchanger section (186), and withdrawing the expanded nitrogen-enriched fraction (128*c*) or the first portion thereof (128*e*) from the first (warmer) end of the second heat exchanger section (186).

Aspect 5. The process according to any one of aspects 1 to 3 further comprising:

passing the expanded nitrogen-enriched fraction (128*c*) to the second (colder) end of the second heat exchanger section (186), heating the expanded nitrogen-enriched fraction (128*c*) in the second heat exchanger section (186), and withdrawing the expanded nitrogen-enriched fraction (128*c*) from the first (warmer) end of the second heat exchanger section (186).

Aspect 6. The process according to any one of aspects 1 to 3 further comprising:

passing a first portion (128*e*) of the expanded nitrogen-enriched fraction (128*c*) to the second (colder) end of the second heat exchanger section (186), heating the first portion (128*e*) of the expanded nitrogen-enriched fraction (128*c*) in the second heat exchanger section (186), and withdrawing the first portion (128*e*) of the expanded nitrogen-enriched fraction (128*c*) from the first (warmer) end of the second heat exchanger section (186).

Aspect 7. The process according to any one of aspects 1 to 6 wherein the first portion (107*c*) of the compressed feed air stream (105) withdrawn from the second (colder) end of the first heat exchanger section (184) is expanded prior to being passed to the higher-pressure column (190) and/or the lower pressure column (188).

Aspect 8. The process according to any one of aspects 1 to 7 further comprising:

passing a third portion 109*b* of the compressed feed air stream (105) into the first (warmer) end of the first heat exchanger section (184), cooling the third portion 109*b* of the compressed feed air stream in the first heat exchanger section (184), and withdrawing the third portion (109*c*) of the compressed air feed stream from a position intermediate the first (warmer) end and the second (colder) end of the first heat exchanger section (184);

expanding the third portion (109*c*) of the compressed feed air stream (105) withdrawn from the position intermediate the first (warmer) end and the second (colder) end of the first heat exchanger section (184) in a second expander (116) to produce work and reduce the pressure of the third portion (109*c*) of the compressed feed air stream (105); and passing the third portion (109*d*) after expanding to at least one of the higher-pressure column (190) or the lower-pressure column (188).

Aspect 9. The process according to aspect 8 wherein the second portion (108*b*) of the compressed feed air stream (105) withdrawn from the second (colder) end of the second heat exchanger section (186) and the third portion (109*d*) after expanding are blended prior to each being passed together to the higher-pressure column (190).

Aspect 10. The process according to any one of aspects 1 to 9 further comprising:

withdrawing a nitrogen-rich byproduct (150) from (the upper region of) the lower-pressure column (188);

passing a first fraction (152*a*) of the nitrogen-rich byproduct (150) withdrawn from the lower-pressure column (188) to a first (colder) end of a first subcooler heat exchanger section (192), heating the first fraction (152*a*) of the nitrogen-rich byproduct (150) in the first subcooler heat exchanger section (192), and withdrawing the first fraction (152*b*) of the nitrogen-rich byproduct (150) from a second (warmer) end of the first subcooler heat exchanger section (192);

passing the first fraction (152*b*) or a first portion (152*c*) thereof of the nitrogen-rich byproduct (150) from the second (warmer) end of the first subcooler heat exchanger section (192) to the second (colder) end of the first heat exchanger section (184), heating the first fraction (152*b*) or first portion (152*c*) thereof of the nitrogen-rich byproduct (150) in the first heat exchanger section (184), and withdrawing the first fraction (152*b*) or first portion (152*c*) thereof of the nitrogen-rich byproduct (150) from the first (warmer) end of the first heat exchanger section (184) as a first nitrogen-rich discharge byproduct gas (162);

passing a second fraction (151*a*) of the nitrogen-rich byproduct (150) withdrawn from the lower-pressure column (188) to a first (colder) end of a second subcooler heat exchanger section (194), heating the second fraction (151*a*) of the nitrogen-rich byproduct (150) in the second subcooler heat exchanger section (194), and withdrawing the second fraction (151*b*) of the nitrogen-rich byproduct (150) from a second (warmer) end of the second subcooler heat exchanger section (194); and passing the second fraction (151*b*) of the nitrogen-rich byproduct (150) from the second (warmer) end of the second subcooler heat exchanger section (194) to the second (colder) end of the second heat exchanger section (186), heating the second fraction (151*b*) of the nitrogen-rich byproduct (150) in the second heat exchanger section (186), and withdrawing the second fraction (151*b*) of the nitrogen-rich byproduct (150) from the first (warmer) end of the second heat exchanger section (186) as a second nitrogen-rich discharge byproduct gas (158).

Aspect 11. The process according to aspect 10 wherein the first portion (152*c*) of the first fraction (152*b*) of the nitrogen-rich byproduct (150) is passed from the second (warmer) end of the first subcooler heat exchanger section (192) to the second (colder) end of the first heat exchanger section (184), heated in the first heat exchanger section (184), and withdrawn from the first (warmer) end of the first heat exchanger section (184) as the first nitrogen-rich discharge byproduct gas (162); the process further comprising:

passing a second portion (152*d*) of the first fraction (152*b*) of the nitrogen-rich byproduct (150) from the second (warmer) end of the first subcooler heat exchanger section (192) to the second (colder) end of the second heat exchanger section (186), heating the second portion (152*d*) of the first fraction (152*b*) of the nitrogen-rich byproduct (150) in the second heat exchanger section (186), and withdrawing the second portion (152*d*) of the first fraction (152*b*) of the nitrogen-rich byproduct (150) from the first (warmer) end of the second heat exchanger section (186) as a third nitrogen-rich discharge product gas (260).

Aspect 12. The process according to aspect 11 wherein the expanded nitrogen-enriched fraction (128*c*) or a first portion (128*e*) thereof is passed to the second (colder) end of the second heat exchanger section (186), heated in the second heat exchanger section (186), and withdrawn from the first (warmer) end of the second heat exchanger section (186); and wherein the second portion (152*d*) of the first fraction (152*b*) of the nitrogen-rich byproduct (150) passed to the second (colder) end of the second heat exchanger section (186) and the expanded nitrogen-enriched fraction (128*c*) or first portion (128*e*) thereof passed to the second (colder) end of the second heat exchanger section (186) are blended and passed together to the second (colder) end of the second heat exchanger section (186).

Aspect 13. The process according to any one of aspects 1 to 9 further comprising:

withdrawing a nitrogen-rich byproduct (150) from (the upper region of) the lower-pressure column (188);

passing a first fraction (152*a*) of the nitrogen-rich byproduct (150) withdrawn from the lower-pressure column (188) to a first (colder) end of a first subcooler heat exchanger section (192), heating the first fraction (152*a*) of the nitrogen-rich byproduct (150) in the first subcooler heat exchanger section (192), and withdrawing the first fraction (152*b*) of the nitrogen-rich byproduct (150) from a second (warmer) end of the first subcooler heat exchanger section (192);

blending the first fraction (152*b*) of the nitrogen-rich byproduct (150) from the second (warmer) end of the first subcooler heat exchanger section (192) with the nitrogen-enriched fraction (128*c*) from the expander (132) to form a nitrogen-rich mixture (258);

passing a first portion (259) of the nitrogen-rich mixture (258) to the second (colder) end of the first heat exchanger section (184), heating the first portion (259) of the nitrogen-rich mixture (258) in the first heat exchanger section (184), and withdrawing the first portion (259) of the nitrogen-rich mixture from the first (warmer) end of the first heat exchanger section (184) as a first nitrogen-rich discharge gas (162);

passing a second portion (256) of the nitrogen-rich mixture (258) to the second (colder) end of the second heat exchanger section (186), heating the second portion (256) of the nitrogen-rich mixture (258) in the second heat exchanger section (186), and withdrawing the second portion (256) of the nitrogen-rich mixture from the first (warmer) end of the second heat exchanger section (186) as a second nitrogen-rich discharge gas (260);

passing a second fraction (151*a*) of the nitrogen-rich byproduct (150) withdrawn from the lower-pressure column (188) to a first (colder) end of a second subcooler heat exchanger section (194), heating the second fraction (151*a*) of the nitrogen-rich byproduct (150) in the second subcooler heat exchanger section (194), and withdrawing the second fraction (151*b*) of the nitrogen-rich byproduct (150) from a second (warmer) end of the second subcooler heat exchanger section (194); and passing the second fraction (151*b*) of the nitrogen-rich byproduct (150) from the second (warmer) end of the second subcooler heat exchanger section (194) to the second (colder) end of the second heat exchanger section (186), heating the second fraction (151*b*) of the nitrogen-rich byproduct (150) in the second heat exchanger section (186), and withdrawing the second fraction (151*b*) of the nitrogen-rich byproduct (150) from the first (warmer) end of the second heat exchanger section (186) as a second nitrogen-rich discharge byproduct gas (158).

Aspect 14. The process according to any one of aspects 9 to 13, further comprising:

passing the nitrogen-rich fraction (127) or a first portion (140) of the nitrogen-rich fraction (127) to a reboiler-condenser (142) of the multi-column distillation system, condensing the the nitrogen-rich fraction (127) or a first portion (140) of the nitrogen-rich fraction (127) in the reboiler-condenser (142), and withdrawing nitrogen-rich liquid (144) from the reboiler-condenser (142);

passing a part (146) of the nitrogen-rich liquid (144) to the second (warmer) end of the second subcooler heat exchanger section (194), cooling the part (146) of the nitrogen-rich liquid (144) in the second subcooler heat exchanger section (194), and withdrawing the part (146) of the nitrogen-rich liquid (144) from the first (colder) end of the second subcooler heat exchanger section (194); and passing the part (146) of the nitrogen-rich liquid (144) withdrawn from the first (colder) end of the second subcooler heat exchanger section (194) to the top end of the lower-pressure column (188).

Aspect 15. The process according to any one of the preceding aspects wherein a nitrogen product (180) is produced, the process further comprising:

withdrawing a nitrogen-rich fraction (127) from the higher-pressure column (190); and passing a second portion (129) of the nitrogen-rich fraction (127) to the second (colder) end of the second heat exchanger section (186), heating the second portion (129) of the nitrogen-rich fraction (127) in the second heat exchanger section (186), and withdrawing the second portion (129) of the nitrogen-rich fraction (127) from the first (warmer) end of the second heat exchanger section (186) as the nitrogen product (180).

Aspect 16. The process according to any one of aspects 9 to 15, further comprising withdrawing an intermediate stream (124) from the higher-pressure column (190);

passing the intermediate stream (124) to the second (warmer) end of the first subcooler heat exchanger section (192), cooling the intermediate stream (124) in the first subcooler heat exchanger section (192), and withdrawing the intermediate stream (124) from the first subcooler heat exchanger section (192); and passing the intermediate stream (124) withdrawn from the first subcooler heat exchanger section (192) to (a location intermediate at top end and a bottom end of) the lower-pressure column (188).

Aspect 17. An apparatus for the separation of a compressed feed air stream (105) to produce an oxygen product (170) and optionally a nitrogen product (180), the apparatus comprising:

a multi-column distillation system comprising a lower-pressure column (188) and a higher-pressure column (190);

a first heat exchanger comprising a first heat exchanger section (184), the first heat exchanger section (184) having a first (warmer) end and a second (colder) end, the first (warmer) end operatively disposed to receive a first portion (107*b*) of the compressed feed air stream (105), wherein at least one of the lower-pressure column (188) or the higher-pressure column (190) is operatively disposed to receive the first portion (107*c*) of the compressed feed air stream (105) from the second (colder) end of the first heat exchanger section (184), wherein the second (colder) end of the first heat exchanger section (184) is operatively disposed to receive an oxygen-rich fraction (166) from the lower-pressure column (188) and the first (warmer) end of the first heat exchanger section (184) is operatively disposed to discharge the oxygen product (170), wherein the second (colder) end of the first heat exchanger section (184) is operatively disposed to receive a nitrogen-enriched fraction (128*a*) from the higher-pressure column (190);

a second heat exchanger comprising a second heat exchanger section (186), the second heat exchanger section (186) having a first (warmer) end and a second (colder) end, the first (warmer) end operatively disposed to receive a second portion (108*a*) of the compressed feed air stream (105), wherein at least one of the lower-pressure column (188) or the higher-pressure column (190) is operatively disposed to receive the second portion (108*b*) of the compressed feed air stream (105) from the second (colder) end of the second heat exchanger section (186); and an expander (132) having an inlet and an outlet, wherein the inlet of the expander (132) is operatively disposed to receive the nitrogen-enriched fraction (128*b*) withdrawn from a position intermediate the first (warmer) end and the second (colder) end of the first heat exchanger section (184).

Aspect 18. The apparatus according to aspect 17 wherein the pressure of the second portion (108*a*) of the compressed feed air stream (105) is less than the pressure of the first portion (107*b*) of the compressed feed air stream (105).

Aspect 19. The apparatus according to aspect 17 or 18 wherein the second heat exchanger has a lower operating pressure rating than the first heat exchanger.

Aspect 20. The apparatus according to any one of aspects 17 to 19 wherein the second (colder) end of the second heat exchanger section (186) is operatively disposed to receive the at least a portion of the nitrogen-enriched fraction (128*c*) from the outlet of the expander 132.

Aspect 21. The apparatus according to any one of aspects 17 to 19 wherein the second (colder) end of the second heat exchanger section (186) is operatively disposed to receive a first portion (128*e*) of the expanded nitrogen-enriched fraction (128*c*) from the outlet of the expander (132); and wherein the second (colder) end of the first heat exchanger section (184) is operatively disposed to receive a second portion (128*d*) of the nitrogen-enriched fraction (128*c*) from the outlet of the expander (132).

Aspect 22. The apparatus according to any one of aspects 17 to 21 further comprising:

a second expander (116) having an inlet and an outlet;

wherein the first (warmer) end of the first heat exchanger section (184) is operatively disposed to receive a third portion (109*b*) of the compressed feed air stream (105) and discharge the third portion (109*c*) from a position intermediate the first (warmer) end and the second (colder) end of the first heat exchanger section (184);

wherein the inlet of the second expander (116) is operatively disposed to receive the third portion (109*c*) withdrawn from the position intermediate the first (warmer) end and the second (colder) end of the first heat exchanger section (184); and wherein at least one of the higher-pressure column (190) or the lower-pressure column (188) is operatively disposed to receive the third portion (109*d*) from the outlet of the second expander (116).

Aspect 23. The apparatus according to any one of aspects 17 to 22 further comprising:

a first subcooler heat exchanger section (192) having a first (colder) end and a second (warmer) end, wherein the first (colder) end of the first subcooler heat exchanger section (192) is operatively disposed to receive a first fraction 152*a* of a nitrogen-rich byproduct (150) from (the upper region of) the lower-pressure column and discharge the first fraction (152*b*) from the second (warmer) end of the first subcooler heat exchanger section (192), wherein the second (colder) end of the first heat exchanger section (184) is operatively disposed to receive at least a first portion (152*c*) of the first fraction (152*b*) from the second (warmer) end of the first subcooler heat exchanger section (192); and a second subcooler heat exchanger section (194) having a first (colder) end and a second (warmer) end, wherein the first (colder) end of the second subcooler heat exchanger section (194) is operatively disposed to receive a second fraction (151*a*) of the nitrogen-rich byproduct (150) and discharge the second fraction (151*b*) from the second (warmer) end of the second subcooler heat exchanger section (194), wherein the second (colder) end of the second heat exchanger section (186) is operatively disposed to receive the second fraction (151*b*) from the second (warmer) end of the second subcooler heat exchanger section (194).

Aspect 24. The apparatus according to aspect 23 wherein the second (colder) end of the second heat exchanger section (186) is operatively disposed to receive a first portion (152*c*) of the first fraction (152*b*) from the second (warmer) end of the first subcooler heat exchanger section (192); and wherein the second (colder) end of the first heat exchanger section (184) is operatively disposed to receive a second portion (152*d*) of the first fraction (152*b*) from the second (warmer) end of the first subcooler heat exchanger section (192).

BRIEF DESCRIPTION OF SEVERAL VIEWS OF THE DRAWINGS

FIG. 5 is a process flow diagram for a comparative process for separating a compressed feed air stream to produce an oxygen product.

FIG. 6 is a process flow diagram for a prior art process for separating a compressed feed air stream to produce an oxygen product.

FIG. 7 is a process flow diagram for a comparative process for separating a compressed feed air stream to produce an oxygen product.

DETAILED DESCRIPTION OF THE PREFERRED EMBODIMENTS

Figure 1:
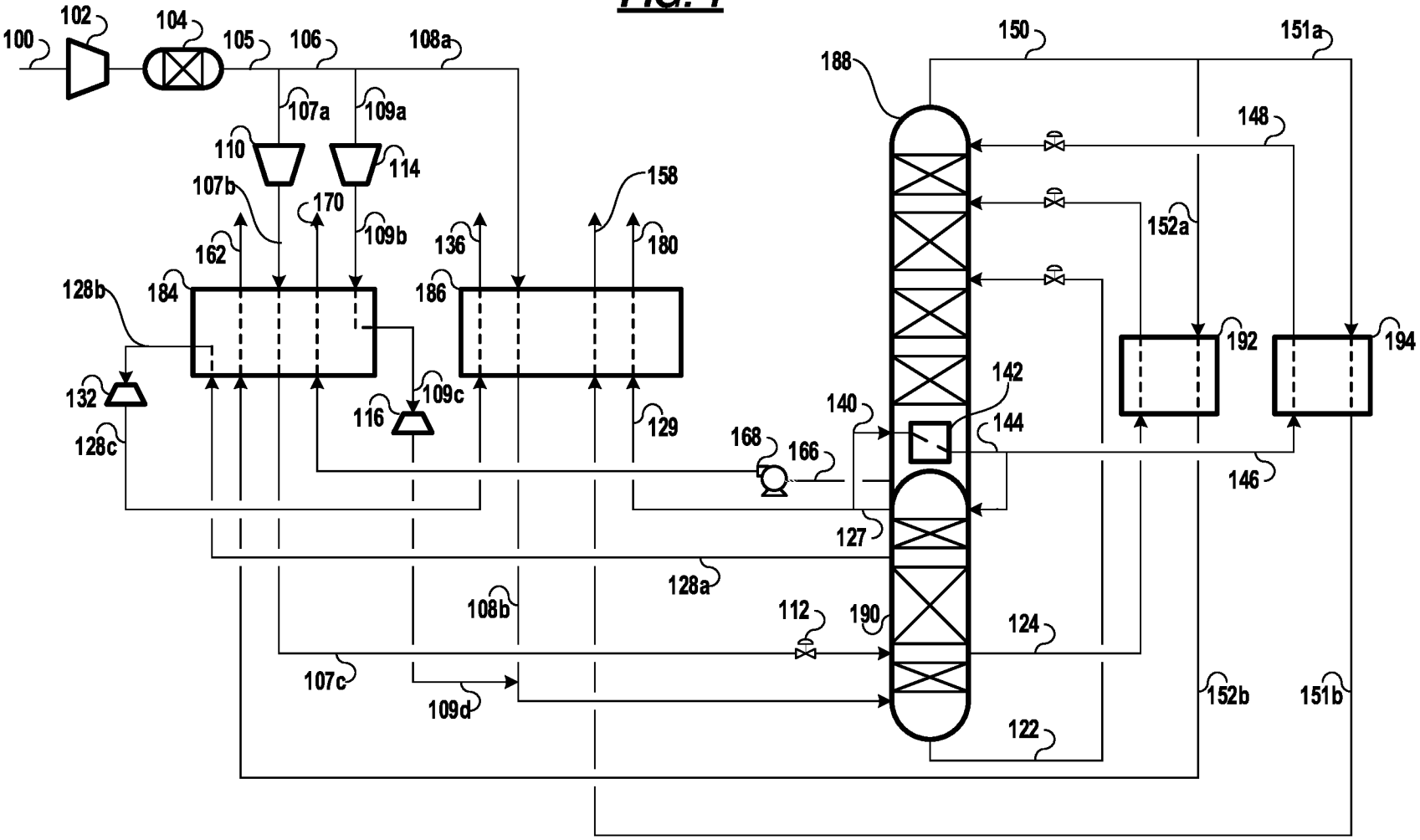
FIG. 1 is a process flow diagram for the present process for separating a compressed feed air stream to produce an oxygen product with high-pressure and low-pressure heat exchangers.

The ensuing detailed description provides preferred exemplary embodiments only, and is not intended to limit the scope, applicability, or configuration of the invention. Rather, the ensuing detailed description of the preferred exemplary embodiments will provide those skilled in the art with an enabling description for implementing the preferred exemplary embodiments of the invention, it being understood that various changes may be made in the function and arrangement of elements without departing from the scope of the invention as defined by the claims.

The articles "a" and "an" as used herein mean one or more when applied to any feature in embodiments of the present invention described in the specification and claims. The use of "a" and "an" does not limit the meaning to a single feature unless such a limit is specifically stated. The article "the" preceding singular or plural nouns or noun phrases denotes a particular specified feature or particular specified features and may have a singular or plural connotation depending upon the context in which it is used.

The adjective "any" means one, some, or all indiscriminately of whatever quantity.

The term "and/or" placed between a first entity and a second entity includes any of the meanings of (1) only the first entity, (2) only the second entity, and (3) the first entity and the second entity. The term "and/or" placed between the last two entities of a list of 3 or more entities means at least one of the entities in the list including any specific combination of entities in this list. For example, "A, B and/or C" has the same meaning as "A and/or B and/or C" and comprises the following combinations of A, B and C: (1) only A, (2) only B, (3) only C, (4) A and B and not C, (5) A and C and not B, (6) B and C and not A, and (7) A and B and C.

The phrase "at least one of" preceding a list of features or entities means one or more of the features or entities in the list of entities, but not necessarily including at least one of each and every entity specifically listed within the list of entities and not excluding any combinations of entities in the list of entities. For example, "at least one of A, B, or C" (or equivalently "at least one of A, B, and C" or equivalently "at least one of A, B, and/or C") has the same meaning as "A and/or B and/or C" and comprises the following combinations of A, B and C: (1) only A, (2) only B, (3) only C, (4) A and B and not C, (5) A and C and not B, (6) B and C and not A, and (7) A and B and C.

The term "plurality" means "two or more than two."

The phrase "at least a portion" means "a portion or all." The at least a portion of a stream may have the same composition with the same concentration of each of the species as the stream from which it is derived. The at least a portion of a stream may have a different concentration of species than that of the stream from which it is derived. The at least a portion of a stream may include only specific species of the stream from which it is derived.

As used herein a "divided portion" of a stream is a portion having the same chemical composition and species concentrations as the stream from which it was taken.

As used herein a "separated portion" of a stream is a portion having a different chemical composition and different species concentrations than the stream from which it was taken.

As used herein, "first," "second," "third," etc. are used to distinguish from among a plurality of steps and/or features, and is not indicative of the total number, or relative position in time and/or space unless expressly stated as such.

The term "depleted" means having a lesser mole % concentration of the indicated component than the original stream from which it was formed. "Depleted" does not mean that the stream is completely lacking the indicated component.

The terms "rich" or "enriched" means having a greater mole % concentration of the indicated component than the original stream from which it was formed.

As used herein, "indirect heat transfer" is heat transfer from one stream to another stream where the streams are not mixed together. Indirect heat transfer includes, for example, transfer of heat from a first fluid to a second fluid in a heat exchanger where the fluids are separated by plates or tubes.

As used herein, "direct heat transfer" is heat transfer from one stream to another stream where the streams are intimately mixed together. Direct heat transfer includes, for example, humidification where water is sprayed directly into a hot air stream and the heat from the air evaporates the water.

Illustrative embodiments of the invention are described below. While the invention is susceptible to various modifications and alternative forms, specific embodiments thereof have been shown by way of example in the drawings and are herein described in detail. It should be understood, however that the description herein of specific embodiments is not intended to limit the invention to the particular forms disclosed, but on the contrary, the invention is to cover all modifications, equivalents, and alternatives falling within the scope of the invention as defined by the appended claims.

For the purposes of simplicity and clarity, detailed descriptions of well-known devices, circuits, and methods are omitted so as not to obscure the description of the present process and apparatus with unnecessary detail.

The present process and apparatus are described with reference to the figures, wherein like reference numbers refer to like elements throughout the figures. Reference numbers for common elements in the figures may be included without explicit description of the common element when discussing each figure. The understanding of the common elements is readily understood from the description of the elements in a related figure.

FIGS. 1, 2A-C, 3A-D, and 4, illustrate various embodiments of the present process and apparatus for separation of a compressed feed air stream 105 to produce an oxygen product 170, and an optional nitrogen product 180. The figures illustrate both required and optional features of the present process and apparatus.

The compressed feed air stream 105 may be formed by compressing air 100 in a main air compressor 102 and removing impurities, such as $CO_2$ and $H_2O$ from the air in adsorption unit 104.

The compressed feed air stream 105 is divided into two or more portions. A first portion 107*a* may be compressed in one or more booster compressors 110 and the compressed first portion 107*b* passed into a first (warmer) end of a first heat exchanger section 184. The first portion 107*b* is cooled in the first heat exchanger section 184, and subsequently withdrawn from a second (colder) end of the first heat exchanger section 184. The compressed first portion 107*b* may be at least partially condensed in the first heat exchanger section 184. The thermodynamic state of the fluid (107*c*) leaving the second (colder) end of heat exchanger section 184 is generally all liquid for any pressure below the critical pressure of air. For pressures greater than the critical pressure of air, the temperature is generally as cold or colder than the critical temperature (approximately −140° C.) and preferably below −160° C. The first heat exchanger section 184 may be part or all of a so-called higher-pressure heat exchanger. The higher-pressure heat exchanger may be a so-called plate-fin heat exchanger or any other type of suitable heat exchanger known in the art.

The first portion 107*c* withdrawn from the second (colder) end of the first heat exchanger section 184 is passed to a multi-column separation system comprising a lower-pressure column 188 and a higher-pressure column 190. The first portion 107*c* may be passed to the higher-pressure column 190 and/or the lower-pressure column of the multi-column separation system. The first portion 107*c* may be a liquid stream, a supercritical dense fluid, or a partially condensed stream. In FIGS. 1, 2A-C, 3A-D, and 4, the first portion 107*c* is passed to the higher-pressure column 190. The first portion 107*c* withdrawn from the second (colder) end of the heat exchanger 184 may be expanded prior to being passed to the higher-pressure column 190 and/or the lower-pressure column 188. The first portion 107*c* of the compressed feed air stream 105 may be expanded in a valve 112, dense fluid expander, or other device known in the art to expand a fluid. The first portion 107*c* may is introduced into the higher-pressure column 190 and/or the lower-pressure column 188 as a predominantly liquid air feed. Alternatively (not shown) the first portion 107*c* may be cooled in first subcooler heat exchange section 192, supplementing or replacing stream 124. In yet another alternative (not shown), the first portion 107*c* may be cooled in the second subcooler heat exchange section 194.

A second portion 108*a* of the compressed feed air stream 105 is passed into a first (warmer) end of a second heat exchanger section 186. The pressure of the second portion 108*a* of the compressed feed air stream 105 may be less than the pressure of the first portion 107*b* of the compressed feed air stream (105). The second portion 108*a* is cooled in the second heat exchanger section 186, and subsequently withdrawn from a second (colder) end of the second heat exchanger section 186. The thermodynamic state of the fluid leaving the second (colder) end of the second heat exchanger section 186 is generally subcritical pressure, typically 4 to 10 atmospheres pressure, and generally no more than 10 mole % liquid, and preferably no more than 3 mole % liquid. The second heat exchanger section 186 may be part or all of a so-called lower-pressure core heat exchanger. The lower-pressure core heat exchanger may be a so-called plate-fin heat exchanger or any other type of heat exchanger known in the art.

The lower-pressure heat exchanger may have a lower operating pressure rating than the higher-pressure heat exchanger. As a result, the lower-pressure heat exchanger may be a lower cost unit than the higher-pressure heat exchanger. Capital cost savings for the heat exchanger system can be achieved for heat exchanger systems using a higher-pressure heat exchanger and a lower-pressure heat exchanger as compared to a heat exchanger system where all of the heat exchangers are rated for higher pressure operation.

The first heat exchanger section 184 and the second heat exchanger section 186 are part of physically and thermodynamically separate heat exchangers. A first heat exchanger comprises first exchanger section 184 and the second heat exchanger comprises the second heat exchanger section 186. The first heat exchanger may be rated for higher pressures than the second heat exchanger. Though it is obvious to one of ordinary skill in the art, the first heat exchanger section is also physically and thermodynamically separate from the second heat exchanger section.

The second portion 108*b* withdrawn from the second (colder) end of the second heat exchanger section 186 is passed to the higher-pressure column 190 of the multi-column separation system.

As shown in FIGS. 1, 2A, 2B, 2C, and 4, a third portion 109*a* of the compressed feed air stream 105 may be compressed in one or more booster compressors 114 and passed into the first (warmer) end of the first heat exchanger section 184. The third portion 109*b* may be cooled in the first heat exchanger section 184, and subsequently withdrawn from a position intermediate the first (warmer) end and the second (colder) end of the first heat exchanger section 184.

While booster compressor 110 and booster compressor 114 are shown as separate machines in FIGS. 1, 2A, 2B, 2C, and 4, the two booster compressors can be a single machine. Both the high pressure air stream 107*b* and the medium pressure air stream 109*b* may be at the same pressure and come from the final stage discharge of the single booster compressor. Alternatively, stream 109*b* may be discharged from an intermediate stage of a single multi-stage booster compressor and stream 107*b* from the final stage of the single multi-stage booster compressor. The booster compressors may be driven by one or both of expander 132 or expander 116.

The third portion 109*c* withdrawn from the position intermediate the first (warmer) end and the second (colder) end of the first heat exchanger section 184 may be expanded in an expander 116 where it is further cooled, while producing work. The third portion 109*d* after expanding may be passed to the higher-pressure column 190 and/or the lower-pressure column 188. Expander 116 may be a dissipative, generator-loaded, or process-loaded expander.

As shown in FIGS. 1, 2A-C, and 4, the third portion 109*d* after expanding and the second portion 108*b* may be blended prior to being passed to the higher-pressure column 190. The combined stream comprising the second portion 108*b* and third portion 109*d* may be introduced as a predominantly vapor feed air into the higher-pressure column 190 at an elevation in the higher-pressure column 190 below that of the first portion 107*c* of the compressed feed air stream 105.

As shown in FIGS. 1, 2A-C, and 4, an oxygen-enriched fraction 122 is withdrawn as a liquid from the bottom section of the higher-pressure column 190 and passed to a lower-pressure column 188 of the multi-column separation system. The oxygen-enriched fraction 122 may be introduced into a middle section of the lower-pressure column 188.

The higher-pressure column 190 and the lower-pressure column 188 are each distillation-type columns. They can be constructed of systems and materials that are well known in the art (for example: sieve trays, bubble-cap trays, valve trays, random packing, structured packing). The higher-pressure column 190 is so-called "higher-pressure" because it has an operating pressure higher than the lower-pressure column 188. The lower-pressure column 188 is so-called "lower-pressure" because it has an operating pressure lower than the higher-pressure column 190. The multi-column separation system may also include one or more additional columns for producing an argon byproduct. At least one additional column may be a standalone column, or part of the lower pressure column 188 where a physical barrier is installed in the lower-pressure column to separate the sections in the lower pressure column.

As shown in FIGS. 1, 2A-C, and 4, an oxygen-rich fraction 166 is withdrawn from a bottom section of the lower pressure column 188. The oxygen-rich fraction 166 is passed to the second (colder) end of the first heat exchanger section 184, heated in the first heat exchanger section 184, and subsequently withdrawn from the first (warmer) end of the first heat exchanger section 184 as oxygen product 170. The pressure of the oxygen-rich fraction 166 withdrawn from the lower pressure column 188 may be increased by passing the oxygen-rich fraction 166 through pump 168. The oxygen-rich fraction 166 may be a liquid stream or a supercritical dense fluid.

As shown in FIGS. 1, 2A-C, and 4, a nitrogen-enriched fraction 128*a* is withdrawn from the higher-pressure column 190. As shown in the figures, the nitrogen-enriched fraction 128*a* may be withdrawn from the higher-pressure column 190 at an elevation below the elevation that the nitrogen-rich fraction 127 is withdrawn. Alternatively, the nitrogen-enriched fraction 128*a* may be withdrawn from the same location as nitrogen-rich fraction 127 and have the same composition as nitrogen-rich fraction 127.

The nitrogen-enriched fraction 128*a* withdrawn from the higher-pressure column 190 is passed to the second (colder) end of the first heat exchanger section 184, heated in the first heat exchanger section 184, and withdrawn from a position intermediate the first (warmer) end and the second (colder) end of the first heat exchanger section 184.

The nitrogen-enriched fraction 128*b* withdrawn from the position intermediate the first (warmer) end and the second (colder) end of the first heat exchanger section 184 is expanded in an expander 132 to produce work and reduce the pressure of the nitrogen-enriched fraction 128*b*. Expander 132 may be a dissipative, generator-loaded, or process-loaded expander.

At least a first portion 128*e* of the expanded nitrogen-enriched fraction 128*c* is passed to the second (colder) end of the second heat exchanger section 186, heated in the second heat exchanger section 186, and withdrawn from the first (warmer) end of the second heat exchanger section 186. In the embodiments shown in FIGS. 1, 2A, 2B, and 3A-D, all of the expanded nitrogen-enriched fraction 128*c* is passed to the second (colder) end of the second heat exchanger section 186. In the embodiments shown in FIGS. 2C, and 4, the nitrogen-enriched fraction 128*c* is blended with another stream 152*b*, described below, and a first portion 128*e* of the expanded nitrogen-enriched fraction 128*c* (as part of the blend) is passed to the second (colder) end of the second heat exchanger section 186 and a second portion 128*d* of the expanded nitrogen-enriched fraction 128*c* (as part of the blend) is passed to the second (colder) end of the first heat exchanger section 184.

In the embodiments shown in FIGS. 2C, 3A, 3B, and 4, a first portion 128*e* of the expanded nitrogen-enriched fraction 128*c* is passed to the second (colder) end of the second heat exchanger section 186, heated in the second heat exchanger section 186, and withdrawn from the first (warmer) end of the second heat exchanger section 186 as part of waste stream 260. A second portion 128*d* of the expanded nitrogen-enriched fraction 128*c* is passed to the second (colder) end of the first heat exchanger section 184, heated in the first heat exchanger section 184, and withdrawn from the first (warmer) end of the first heat exchanger section 184 as a part of waste stream 162.

As shown in FIGS. 1, 2A-C, and 4, a nitrogen-rich byproduct 150 may be withdrawn from the upper region of the lower-pressure column 188. The nitrogen-rich byproduct 150 may be divided into a first fraction 152*a* and a second fraction 151*a*. The upper region is defined as section bound by point where nitrogen-enriched intermediate stream 124 enters the lower-pressure column and the lower-pressure column top end. Typically, the top end is the location where stream 148 enters the lower-pressure column.

The first fraction 152*a* of the nitrogen-rich byproduct 150 may be passed to a first (colder) end of a first subcooler heat exchanger section 192, heated in the first subcooler heat exchanger section 192, and withdrawn from a second (warmer) end of the first subcooler heat exchanger section 192.

Figure 2A:
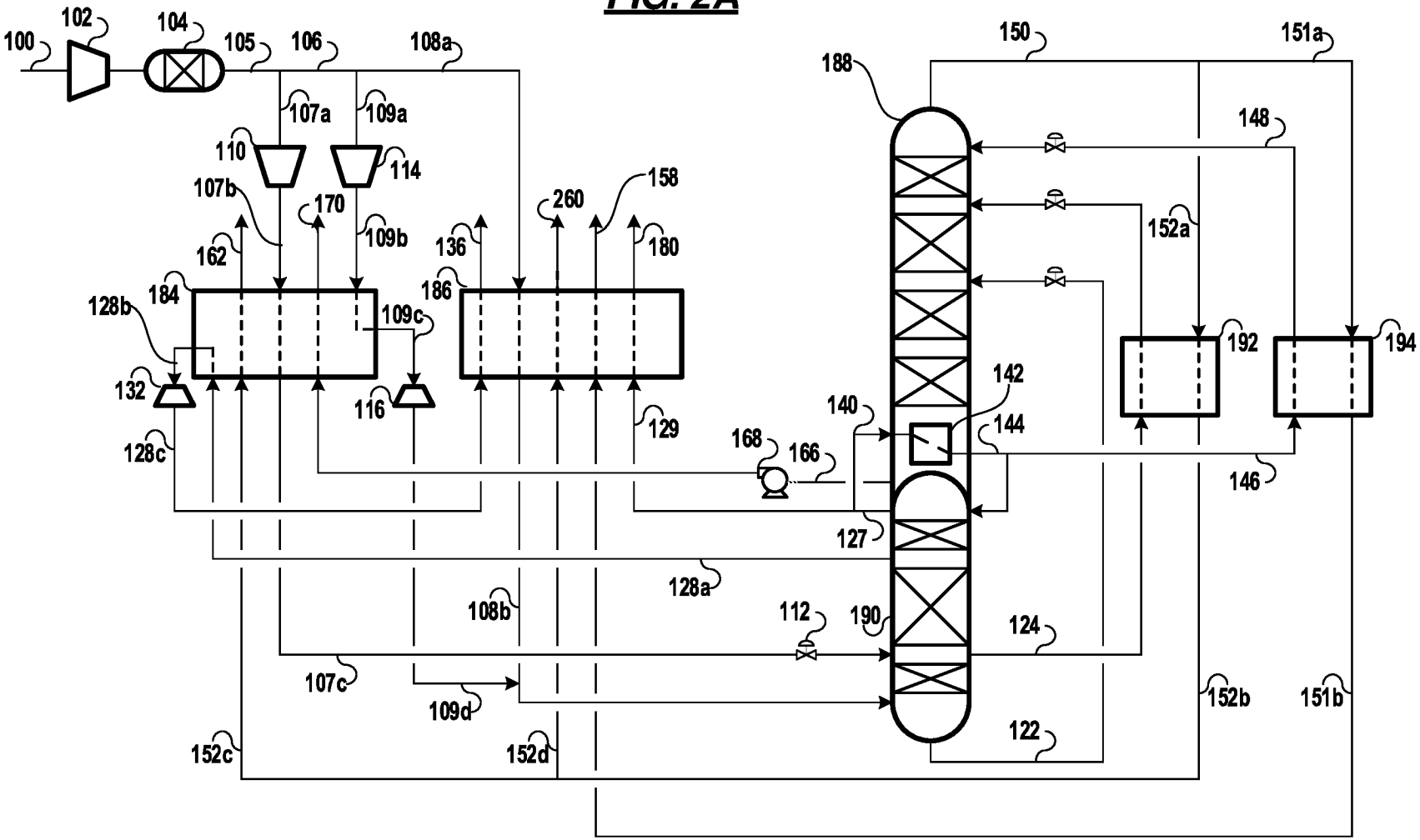
FIGS. 2A-C are other process flow diagrams for the present process for separating a compressed feed air stream to produce an oxygen product with high-pressure and low-pressure heat exchangers.
Figure 2B:
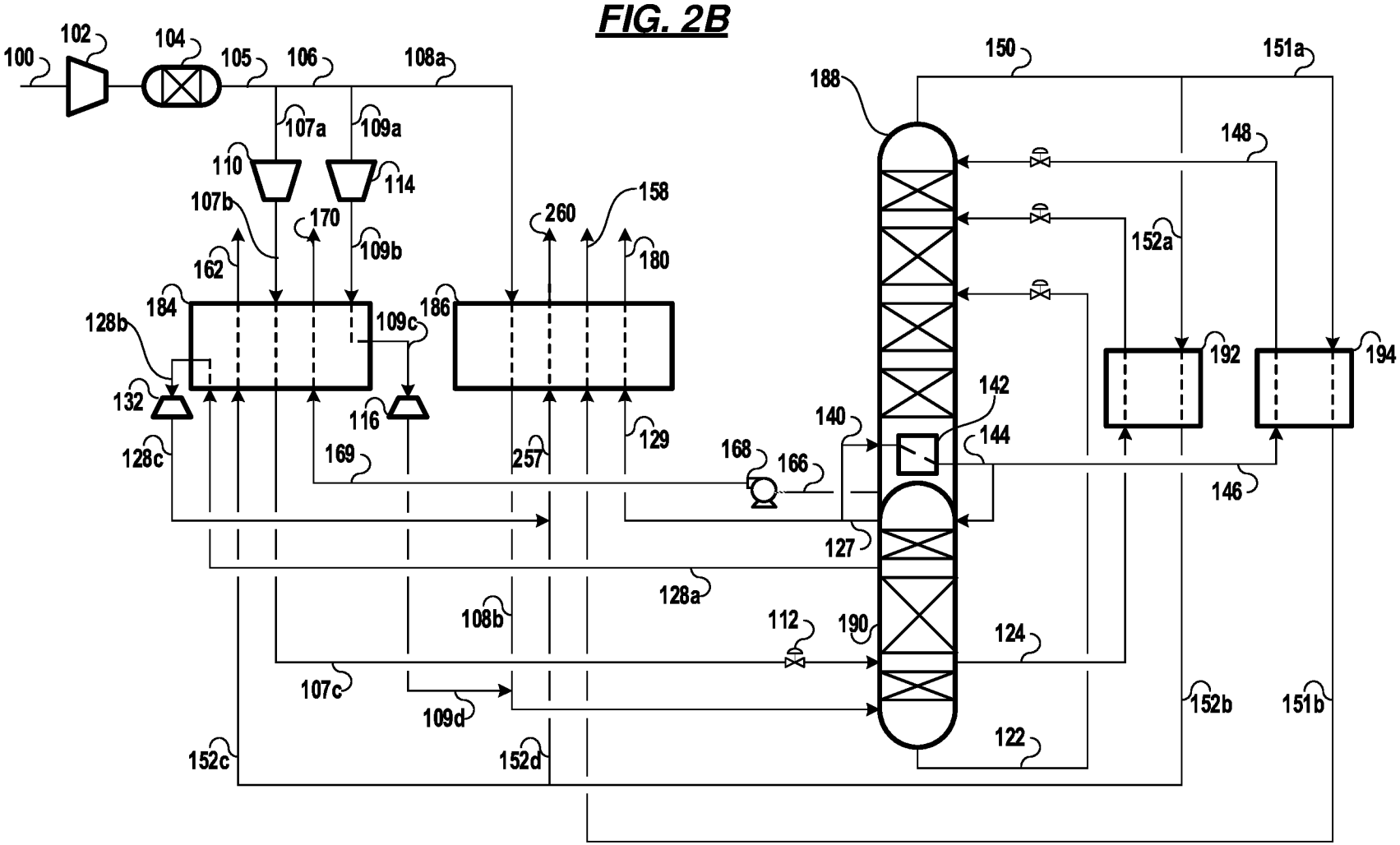

In the embodiments shown in FIGS. 1, 2A, and 2B, the at least a portion of the first fraction 152*b* of the nitrogen-rich byproduct 150 is passed from the second (warmer) end of the first subcooler heat exchanger section 192 to the second (colder) end of the first heat exchanger section 184, heated in the first heat exchanger section 184, and withdrawn from the first (warmer) end of the first heat exchanger section 184 as a first nitrogen-rich discharge byproduct gas 162.

In the embodiments shown in FIGS. 2A and 2B, a second portion 152*d* of the first fraction 152*b* of the nitrogen-rich byproduct 150 is passed from the second (warmer) end of the first subcooler heat exchanger section 192 to the second (colder) end of the second heat exchanger section 186, heated in the second heat exchanger section 186, and withdrawn from the first (warmer) end of the second heat exchanger section 186 as a third nitrogen-rich discharge product gas 260.

In the embodiment shown in FIG. 2B, the second portion 152*d* of the first fraction 152*b* of the nitrogen-rich byproduct 150 is blended with the expanded nitrogen-enriched fraction 128*c* from the expander 132 and passed together through the second (colder) end of the second heat exchanger section 186.

Figure 2C:
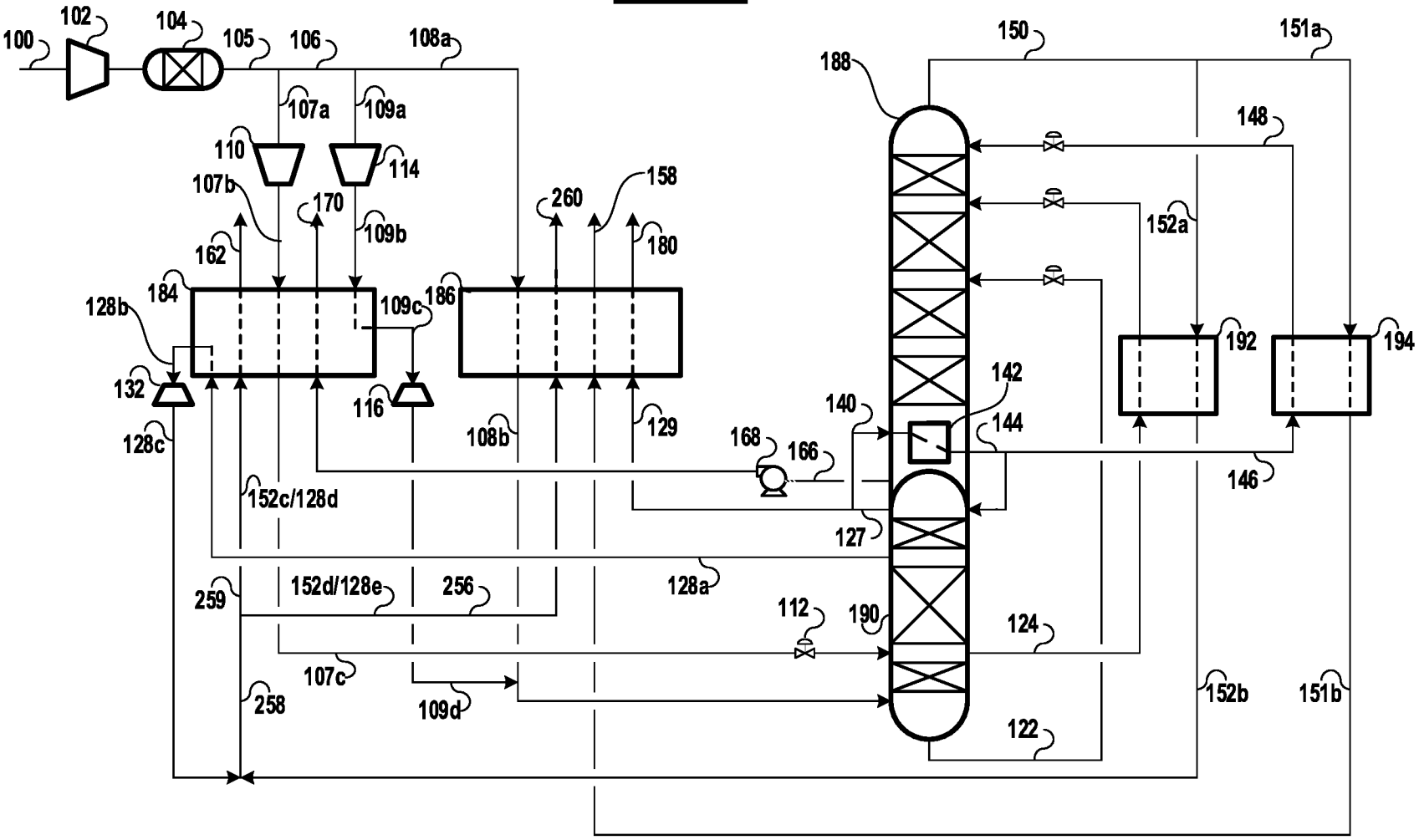
Figure 4:
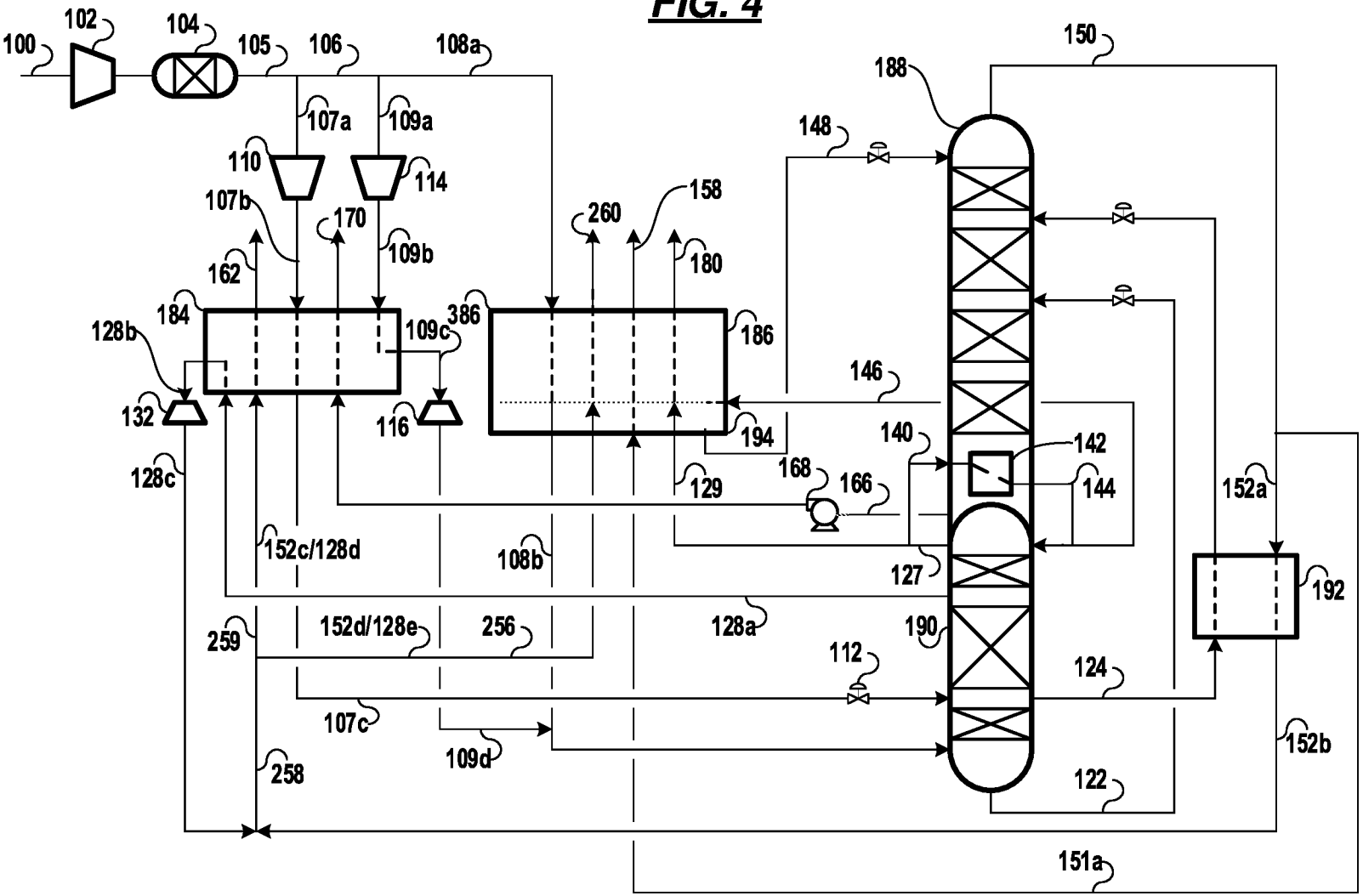
FIG. 4 is a process flow diagram for the present process for separating a compressed feed air stream to produce an oxygen product with high-pressure and low-pressure heat exchangers.

In the embodiments shown in FIGS. 2C and 4, the first fraction 152*b* of the nitrogen-rich byproduct 150 from the second (warmer) end of the first subcooler heat exchanger section 192 is blended with the nitrogen-enriched fraction 128*c* from the expander 132 to form a nitrogen-rich mixture 258. A first portion 259 of the nitrogen-rich mixture 258 is passed to the second (colder) end of the first heat exchanger section 184, heated in the first heat exchanger section 184, and withdrawn from the first (warmer) end of the first heat exchanger section 184 as a first nitrogen-rich discharge gas 162. A second portion 256 of the nitrogen-rich mixture 258 is passed to the second (colder) end of the second heat exchanger section 186, heated in the second heat exchanger section 186, and withdrawn from the first (warmer) end of the second heat exchanger section 186 as a second nitrogen-rich discharge gas 260.

The advantage of blending the first fraction 152*b* of the nitrogen-rich byproduct 150 with the nitrogen-enriched fraction 128*c* from the expander 132 is to provide the greatest flexibility to control the flow split of streams 128*c* and 152*b* between the first heat exchanger section 184 and the second heat exchanger section 186. This flexibility will lead to the most efficient operation.

As shown in each of the embodiments of FIGS. 1-4, the second fraction 151*a* of the nitrogen-rich byproduct 150 may be passed to a first (colder) end of a second subcooler heat exchanger section 194, heated in the second subcooler heat exchanger section 194, and withdrawn from a second (warmer) end of the second subcooler heat exchanger section 194.

The second fraction 151*b* of the nitrogen-rich byproduct 150 may be passed from the second (warmer) end of the second subcooler heat exchanger section 194 to the second (colder) end of the second heat exchanger section 186, heated in the second heat exchanger section 186, and withdrawn from the first (warmer) end of the second heat exchanger section 186 as a second nitrogen-rich discharge byproduct gas 158.

In an alternative embodiment, a low pressure nitrogen product can be produced by withdrawing a nitrogen-rich gas stream (not shown) from the top end of upper region of the lower-pressure column 188, optionally heating this nitrogen-rich gas stream in the first subcooler heat exchanger section 192 and/or second subcooler heat exchanger section 194, or a third subcooler heat exchanger, and subsequently heating the nitrogen-rich gas stream further in the first heat exchanger section 184 and/or the second heat exchanger section 186. In this case, the nitrogen-rich byproduct 150 may be removed from the lower-pressure column 188 as a vapor-side draw from a location in the upper region below where the nitrogen-rich gas stream is withdrawn. If the flow rate of the nitrogen-rich gas stream is of sufficient magnitude, one of the first fraction 152*a* of the nitrogen-rich byproduct 150 and the second fraction 151*a* of the nitrogen-rich byproduct 150 may be eliminated and replaced with this nitrogen-rich gas stream.

As shown in each of the embodiments of FIGS. 1, 2A, 2B, 2C, and 4, a nitrogen-rich fraction 127 may be withdrawn from the top end of the higher-pressure column 190. A second portion 129 of the nitrogen-rich fraction 127 may be passed to the second (colder) end of the second heat exchanger section 186, heated in the second heat exchanger section 186, and subsequently withdrawn from the first (warmer) end of the second heat exchanger section 186 as a gaseous nitrogen product 180. Alternatively, second portion 129 may be heated in the second heat exchanger section 186.

Though not shown, it is well known in the art to produce gaseous nitrogen product 180 using an alternate technique called pumped-LIN. With this technique, an additional liquid is withdrawn from stream 144, optionally pumped to a pressure greater than that of the higher-pressure column (190) and may be subsequently passed to the second (colder) end of the first heat exchanger section 184, heated in the first heat exchanger section 184, and subsequently withdrawn from the first (warmer) end of the first heat exchanger section 184 as a gaseous nitrogen product 180.

The nitrogen-rich fraction 127 or a first portion 140 of the nitrogen-rich fraction 127 withdrawn from the top end of the higher-pressure column 190 may be passed to a reboiler-condenser 142 of the multi-column distillation system. The nitrogen-rich fraction 127 or a first portion 140 of the nitrogen-rich fraction 127 may be condensed in the reboiler-condenser 142, and withdrawn from the reboiler-condenser 142 as nitrogen-rich liquid 144. The reboiler-condenser 142 thermally couples the lower-pressure column 188 and the higher-pressure column 190.

A large part (greater than 40 mole %) of the nitrogen-rich liquid (144) is returned to the top of the higher-pressure column 190 as reflux. A part 146 of the nitrogen-rich liquid (144) may be passed to a second (warmer) end of the second subcooler heat exchanger section 194, cooled in the second subcooler heat exchanger section 194, and withdrawn from the first (colder) end of the second subcooler heat exchanger section 194. The part 146 of the nitrogen-rich liquid (144) withdrawn from the first (colder) end of the second subcooler heat exchanger section 194 may be passed to the top end of the lower-pressure column 188 as reflux. Alternatively, a part 146 of the nitrogen-rich liquid (144) may be passed to a second (warmer) end of the first subcooler heat exchanger section 192, cooled in the first subcooler heat exchanger section 192, and withdrawn from the first (colder) end of the first subcooler heat exchanger section 192.

While the figures show stream 146 which is passed through the second subcooler heat exchanger section 194 being formed from the stream withdrawn from the reboiler-condenser, this stream may alternatively be taken from an intermediate location in the higher-pressure column. For example, stream 146 may be taken as a liquid draw from the location of stream 128*a* off-take. In such an event, all of the nitrogen-rich liquid (144) is returned to the top of the higher-pressure column 190 as reflux.

As shown in each of the embodiments of FIGS. 1, 2A, 2B, 2C, and 4, a nitrogen-enriched intermediate 124 may be withdrawn from the higher-pressure column 190 from an elevation in the higher-pressure column which is above that of the predominantly liquid air feed. The nitrogen-enriched intermediate 124 may be passed to the second (warmer) end of the first subcooler heat exchanger section 192, cooled in the first subcooler heat exchanger section 192, withdrawn from the first (colder) end of the first subcooler heat exchanger section 192, and passed to an intermediate section of the lower-pressure column 188. Alternatively, the nitrogen-enriched intermediate 124 may be passed to the second (warmer) end of the second subcooler heat exchanger section 194, cooled in the second subcooler heat exchanger section 194, withdrawn from the first (colder) end of the second subcooler heat exchanger section 194, and passed to an intermediate section of the lower-pressure column 188.

The first subcooler heat exchanger section 192 may be structurally integrated with the first heat exchanger section 184.

The second subcooler heat exchanger section 194 may be structurally integrated with the second heat exchanger section 186.

Figure 3A:
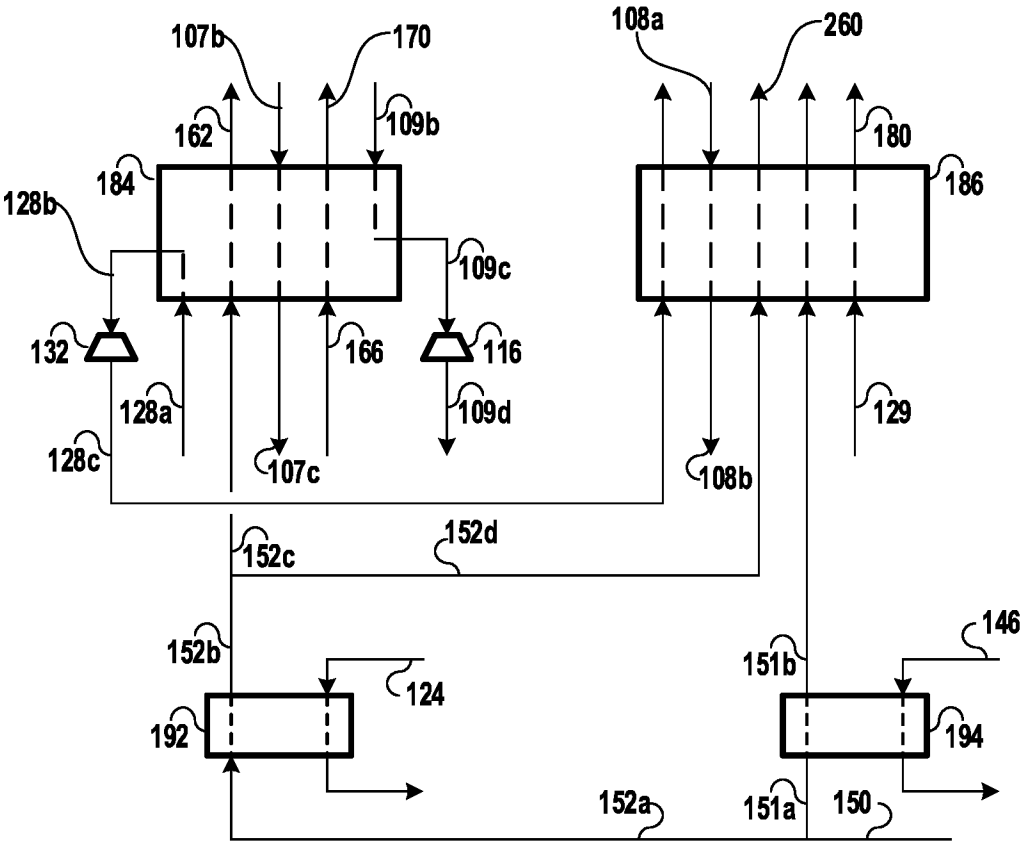
FIGS. 3A-D are process flow diagrams for various heat exchanger networks for the present process.

The integration of the subcooler heat exchanger sections 192, 194 with the heat exchanger sections 184, 186 is described with reference to FIGS. 3A-D. FIG. 3A illustrates the same heat exchanger subprocess of FIG. 2A where the subcooler heat exchanger sections 192 and 194 are separate from the heat exchanger sections 184 and 186.

Figure 3B:
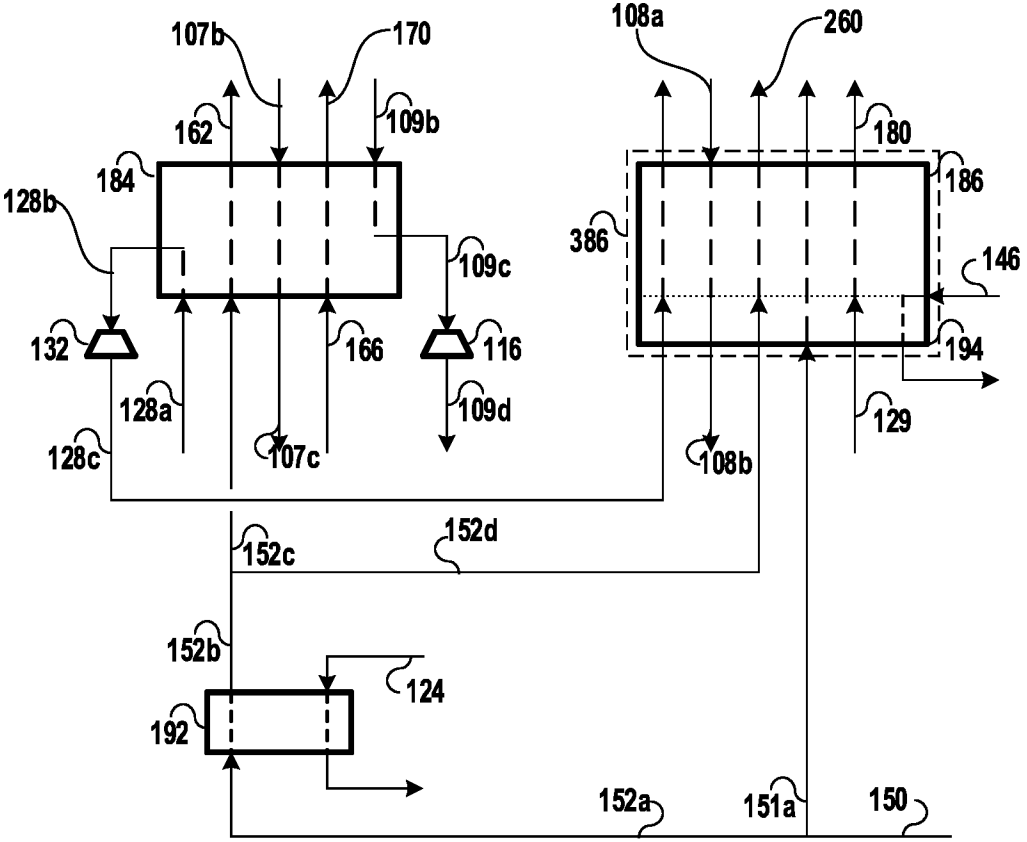

In the embodiment shown in FIG. 3B, the second subcooler heat exchanger section 194 is integrated with the second heat exchanger section 186 as a single heat exchanger 386. The horizontal dotted line shown in the heat exchanger 386 represents the boundary, or interface, between the second subcooler heat exchanger section 194 and the second heat exchanger section 186.

The part 146 of the nitrogen-rich liquid fraction (144) is passed to the second (warmer) end of the second subcooler heat exchanger section 194 of the heat exchanger 386, bypassing the second heat exchanger section 186, and is withdrawn from the first (colder) end of the second subcooler heat exchanger section 194 of the heat exchanger 386. The second fraction 151*a* of the nitrogen-rich byproduct 150 is passed to the first (colder) end of the second subcooler heat exchanger section 194 of the heat exchanger 386 and is withdrawn from the first (warmer) end of the second heat exchanger section 186 of the heat exchanger 386. The expanded nitrogen-enriched fraction 128*c*, the second portion 152*d* of the first fraction 152*a* of the nitrogen-rich byproduct 150, and the second portion 129 of the nitrogen-rich fraction 127 are each passed to the second (colder) end of the second heat exchanger section 186 of the heat exchanger 386, bypassing the second subcooler heat exchanger section 194, and withdrawn from the first (warmer) end of the second heat exchanger section 186 of the heat exchanger 386. The second portion 108*b* of the compressed feed air stream is passed to the first (warmer) end of the second heat exchanger section 186 and is withdrawn from the second (colder) end of the second heat exchanger section 186 of the heat exchanger 386 bypassing the second subcooler heat exchanger section 194 of the heat exchanger 386.

This type of heat exchanger arrangement is commonly used to reduce capital costs. The heat transfer efficiency of the heat exchanger arrangement shown in FIG. 3B for the second subcooler heat exchanger section 194 and second heat exchanger section 186 is essentially equivalent to the heat exchanger arrangement shown in FIG. 3A.

Figure 3C:
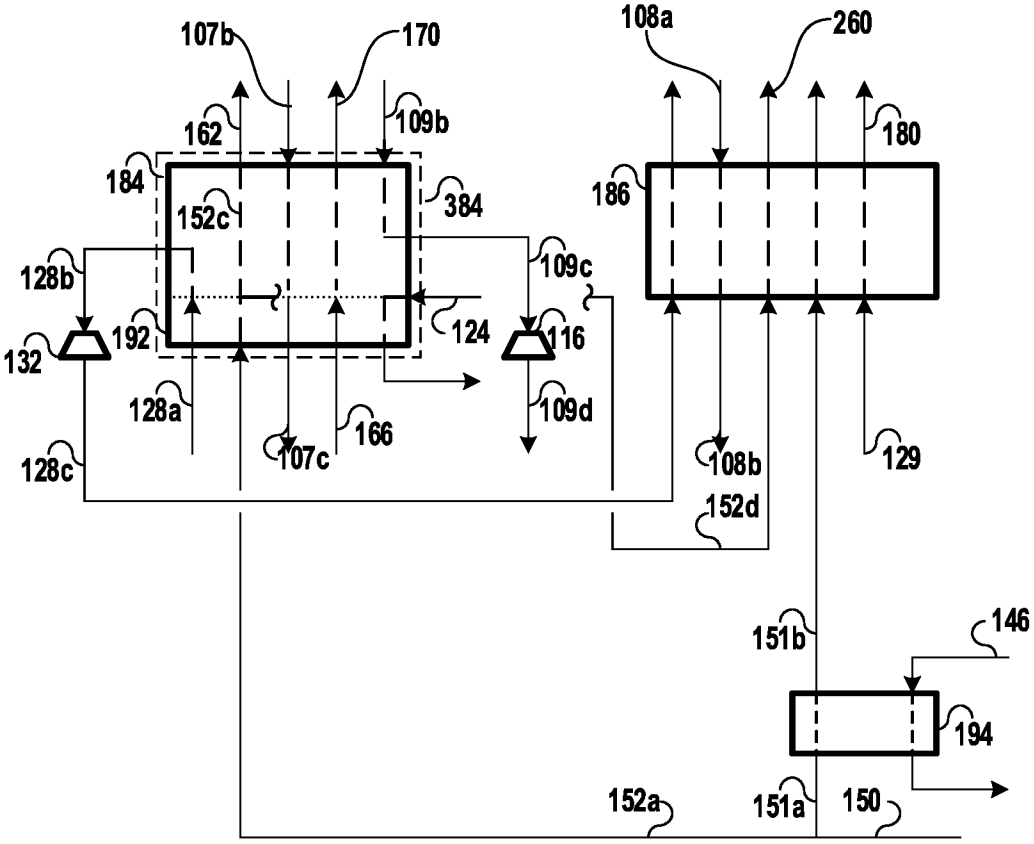

In the embodiment shown in FIG. 3C, the first subcooler heat exchanger section 192 is integrated with the first heat exchanger section 184 as a single heat exchanger 384. The horizontal dotted line shown in the heat exchanger 384 represents the boundary between the first subcooler heat exchanger section 192 and the first heat exchanger section 184. The dotted line represents the interface between the second (warmer) end of the first subcooler heat exchanger section 192 and the second (colder) end of the first heat exchanger section 184.

The first fraction 152*a* of the nitrogen-rich byproduct 150 is passed to the first (colder) end of the first subcooler heat exchanger section 192 of the heat exchanger 384. A first portion 152*c* of the first fraction 152*b* of the nitrogen-rich byproduct 150 passes from the second (warmer) end of the first subcooler heat exchanger section 192 of the heat exchanger 384 to the second (colder) end of the first heat exchanger section 184 and is withdrawn from the first (warmer) end of the first heat exchanger section 184 of the heat exchanger 384 as the first nitrogen-rich discharge byproduct gas 162. A second portion 152*d* of the first fraction 152*b* of the nitrogen-rich byproduct 150 is withdrawn from the second (warmer) end of the first subcooler heat exchanger section 184 of the heat exchanger 384 bypassing the first heat exchanger section 184. The nitrogen-enriched fraction 128*c* and the oxygen-rich fraction 166 are each passed to the second (colder) end of the first heat exchanger section 184 of the heat exchanger 384, bypassing the first subcooler heat exchanger section 192, and withdrawn from the first (warmer) end of the first heat exchanger section 184 of the heat exchanger 384.

This type of heat exchanger arrangement is commonly used to reduce capital costs. The heat transfer efficiency of the heat exchanger arrangement shown in FIG. 3C for the first subcooler heat exchanger section 192 and first heat exchanger section 184 is essentially equivalent to the heat exchanger arrangement shown in FIG. 3A.

Figure 3D:
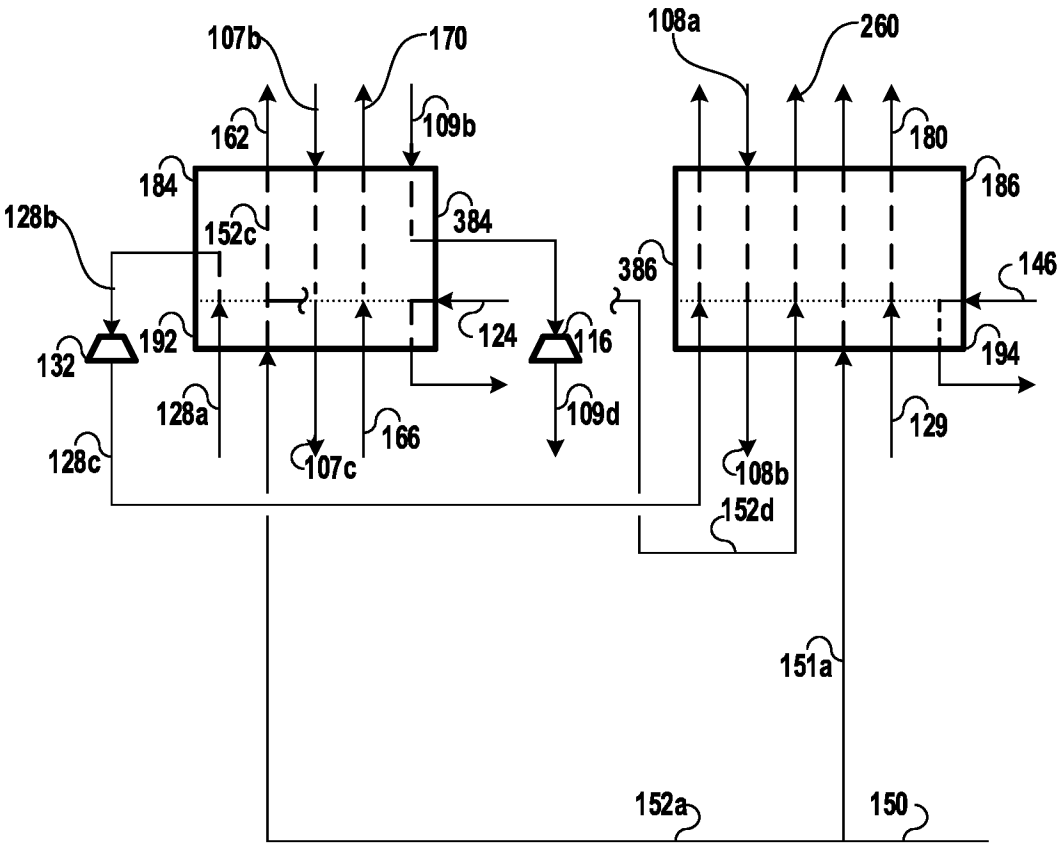

In the embodiment shown in FIG. 3D, first subcooler heat exchanger section 192 is integrated with the first heat exchanger section 184 as a single heat exchanger 384 and the second subcooler heat exchanger section 194 is integrated with the second heat exchanger section 186 as a single heat exchanger 386. The description for the integrated heat exchanger 384 for FIG. 3C and the description for the integrated heat exchanger 386 for FIG. 3B applies to the integrated heat exchangers 384 and 386. The heat transfer efficiency of the heat exchanger arrangement shown in FIG. 3D for the integrated heat exchangers 384 and 386 are essentially equivalent to the heat exchanger arrangement shown in FIG. 3A for separated heat exchangers.

In the embodiment shown in FIG. 4, the integrated heat exchanger 386 in FIG. 3B is applied to the process flow diagram of FIG. 2C.

The apparatus according to the present disclosure comprises a multi-column distillation system comprising a lower-pressure column 188 and a higher-pressure column 190, a first heat exchanger, a second heat exchanger, and an expander 132.

The first heat exchanger comprises a first heat exchanger section 184. The first heat exchanger section 184 has a first (warmer) end and a second (colder) end. The first (warmer) end is operatively disposed to receive a first portion 107*b* of the compressed feed air stream 105. The apparatus may comprise a booster compressor 110 and the first (warmer) end may be operatively disposed to receive the first portion 107*b* from a booster compressor 110. At least one of the lower-pressure column 188 or the higher-pressure column 190 is operatively disposed to receive the first portion 107*c* of the compressed feed air stream 105 from the second (colder) end of the first heat exchanger section 184. The second (colder) end of the first heat exchanger section 184 is operatively disposed to receive an oxygen-rich fraction 166 from the lower-pressure column 188 and the first (warmer) end of the first heat exchanger section 184 is operatively disposed to discharge the oxygen product 170. The second (colder) end of the first heat exchanger section 184 is operatively disposed to receive a nitrogen-enriched fraction 128*a* from the higher-pressure column 190.

The second heat exchanger comprises a second heat exchanger section 186. The second heat exchanger may have a lower operating pressure rating than the first heat exchanger. The second heat exchanger section 186 has a first (warmer) end and a second (colder) end. The first (warmer) end is operatively disposed to receive a second portion 108*a* of the compressed feed air stream 105. The pressure of the second portion 108*a* of the compressed feed air stream 105 may be less than the pressure of the first portion 107*b* of the compressed feed air stream 105. The higher-pressure column 190 is operatively disposed to receive the second portion 108*b* of the compressed feed air stream 105 from the second (colder) end of the second heat exchanger section 186.

The expander 132 has an inlet and an outlet. The inlet of the expander 132 is operatively disposed to receive the nitrogen-enriched fraction 128*b* withdrawn from a position intermediate the first (warmer) end and the second (colder) end of the first heat exchanger section 184.

As shown in FIG. 1, the second (colder) end of the second heat exchanger section 186 may be operatively disposed to receive the at least a portion of the nitrogen-enriched fraction 128*c* from the outlet of the expander 132.

As shown in FIGS. 2C and 4, the second (colder) end of the second heat exchanger section 186 may be operatively disposed to receive a first portion 128*e* of the expanded nitrogen-enriched fraction 128*c* from the outlet of the expander 132, and the second (colder) end of the first heat exchanger section 184 may be operatively disposed to receive a second portion 128*d* of the nitrogen-enriched fraction 128*c* from the outlet of the expander 132.

As shown in FIGS. 1 to 4, the apparatus may further comprise a second expander 116 having an inlet and an outlet. The first (warmer) end of the first heat exchanger section 184 may be operatively disposed to receive a third portion 109*b* of the compressed feed air stream 105 and discharge the third portion 109*c* from a position intermediate the first (warmer) end and the second (colder) end of the first heat exchanger section 184. The inlet of the second expander 116 may be operatively disposed to receive the third portion 109*c* withdrawn from the position intermediate the first (warmer) end and the second (colder) end of the first heat exchanger section 184. At least one of the higher-pressure column 190 or the lower-pressure column 188 may be operatively disposed to receive the third portion 109*d* from the outlet of the second expander 116.

As shown in FIGS. 1 to 4, the apparatus may further comprise a first subcooler heat exchanger section 192 and a second subcooler heat exchanger section 194.

The first subcooler heat exchanger section 192 has a first (colder) end and a second (warmer) end. The first (colder) end of the first subcooler heat exchanger section 192 may be operatively disposed to receive a first fraction 152*a* of a nitrogen-rich byproduct 150 from the upper region of the lower-pressure column and discharge the first fraction 152*b* from the second (warmer) end of the first subcooler heat exchanger section 192. The second (colder) end of the first heat exchanger section 184 may be operatively disposed to receive the at least a portion of first fraction 152*b* from the second (warmer) end of the first subcooler heat exchanger section 192.

The second subcooler heat exchanger section 194 has a first (colder) end and a second (warmer) end. The first (colder) end of the second subcooler heat exchanger section 194 may be operatively disposed to receive a second fraction 151*a* of the nitrogen-rich byproduct 150 and discharge the second fraction 151*b* from the second (warmer) end of the second subcooler heat exchanger section 194. The second (colder) end of the second heat exchanger section 186 may be operatively disposed to receive at the second fraction 151*b* from the second (warmer) end of the second subcooler heat exchanger section 194.

As shown in FIG. 4, the second (colder) end of the second heat exchanger section 186 may be operatively disposed to receive a second portion 152*d* of the first fraction 152*b* from the second (warmer) end of the first subcooler heat exchanger section 192 and the second (colder) end of the first heat exchanger section 184 may be operatively disposed to receive a first portion 152*c* of the first fraction 152*b* from the second (warmer) end of the first subcooler heat exchanger section 192.

Example

Computer simulations for various heat exchanger configurations were conducted using Aspen Plus®.

The basis for the simulations are as follows:

| | |
|---|---|
| Ambient Pressure (bara) | 1.0 |
| Ambient Temperature (° C.) | 25 |
| Cooling Water Supply (° C.) | 25 |

-continued

| | |
|---|---|
| Oxygen Product (stream 170) | |
| Flow rate ($nm^3/h$) | 100,000 |
| Pressure (bara) | 65 |
| Nitrogen Product (stream 180) | |
| Flow rate ($nm^3/h$) | 5,000 |
| Pressure (bara) | 5.0 |

Some key results are summarized in Table 1.

The results shown in the 1st column, Case 1, corresponds to the process shown in FIG. 5, where the first and second heat exchanger sections are combined into one single heat exchanger section 584 and first and second subcooler heat exchanger sections are combined into one single subcooler heat exchanger section 596. Reference numbers for streams in FIG. 5 in common with the earlier figures have the same reference number as in the earlier figures. Note that there is no need to split nitrogen-rich byproduct 150 as it flows through the heat exchanger system (150-551, 558). This case represents the lowest power achievable. This is because combining all the streams into one, single heat exchanger provides the greatest flexibility to thermally balance the heat loads and therefore achieve highest thermodynamic efficiency. It is typical that when splitting the heat exchanger system into two parallel heat exchangers, the lowest power achievable can only approach, but will not meet that of Case 1.

The results shown in the 2nd column, Case 2, represents the prior art and corresponds to the process shown FIG. 6. The process of FIG. 6 is similar to that of FIG. 1 but follows the teachings of EP 2824407. In particular, expander 132 receives its flow from the second heat exchanger section 186. Also note that second subcooler heat heat exchanger section 194 has been integrated with second heat exchanger section 186 to create second heat exchanger 386. The power penalty compared to Case 1, 1146 kW, is greatest and is due primarily to the ineffective use of expander 132 resulting in high air expander flow 109*b*.

The results shown in the 3rd column, Case 3, corresponds to an embodiment of the invention as shown in FIG. 1, where expander 132 receives its flow from the first heat exchanger section 184. Of note, this configuration enables the inlet temperature to expander 132 (stream 128*b*) to be warmer compared to the prior art and approaches that of the Case 1. In addition, the flow of stream 128*b* is slightly larger compared to the prior art Case 2. The resultant refrigeration produced by expander 132 is thus greater than that of Case 2, and results in a reduction of (compressed) air expander flow (stream 109*b*). The power is reduced by 384 kW compared to Case 2 (Prior Art).

The results shown in the 4th column, Case 4, are for a comparative case shown in FIG. 7. The results show the modest effect of only splitting stream 258 between the two heat exchangers. Case 4 can be envisioned as the embodiment of FIG. 4 except expander 132 draws its flow from the second heat exchanger section 186, as in the prior art case. The power is reduced by 120 kW compared to Case 2 (Prior Art).

The results shown in the 5th column, Case 5, correspond to an embodiment of the invention as shown in FIG. 4. In this case, not only does expander 132 receive its flow from the first heat exchanger section 184, but also expander 132 discharge stream 128*c*, after having been mixed with low pressure nitrogen stream 152*b*, is split between the first and second heat exchangers sections. By making both changes, further benefits can be achieved over simply combining the individual benefits of case 3 and 4. The power is reduced by 741 kW compared to Case 2 (Prior Art). This power is nearly comparable to that of the Case 1. It is noteworthy that the expander 132 flow, and temperatures approach closely those of the Case 1—hence the further reduction of (compressed) air expander flow compared to the Prior Art.

TABLE 1

| | | Case 1 FIG. 5 | Case 2 FIG. 6 | Case 3 FIG. 1 | Case 4 FIG. 7 | Case 5 FIG. 4 |
|---|---|---|---|---|---|---|
| Power | kW | 56,417 | 57,563 | 57,175 | 57,443 | 56,882 |
| Penalty compared to Case 1 | kW | — | 1,146 | 758 | 1,026 | 405 |
| Improvement compared to Case 2 | kW | 1,146 | — | 388 | 120 | 741 |
| Dry Air flow (105) | $Nm^3/hr$ | 483,477 | 481,731 | 482,950 | 482,137 | 483,705 |
| MP Air flow (108a) | $Nm^3/hr$ | 309,030 | 278,692 | 292,946 | 280,165 | 295,738 |
| MP Air pressure (108a) | bara | 5.6 | 5.6 | 5.6 | 5.6 | 5.5 |
| JT Air flow (107b) | $Nm^3/hr$ | 135,003 | 114,274 | 129,088 | 114,571 | 127,441 |
| JT Air pressure (107b) | bara | 75 | 75 | 75 | 75 | 75 |
| Air Expander flow (109b) | $Nm^3/hr$ | 39,444 | 88,764 | 60,916 | 87,401 | 60,526 |
| Air Expander pressure (109b) | bara | 35 | 35 | 35 | 35 | 35 |
| $N_2$ Expander flow (128b) | $Nm^3/hr$ | 56,124 | 45,790 | 49,521 | 47,201 | 53,856 |
| T into expander (128b) | ° C. | −123 | −163 | −123 | −160 | −125 |
| T out of expander (128c) | ° C. | −168 | −194 | −168 | −193 | −168 |
| Lower pressure $N_2$-enriched (136) | $Nm^3/hr$ | 56,124 | 45,790 | 49,521 | — | — |
| First $N_2$ discharge (158) | $Nm^3/hr$ | 321,748 | 246,440 | 258,460 | 152,290 | 153,762 |
| Second $N_2$ discharge (162) | $Nm^3/hr$ | — | 83,895 | 69,361 | 81,709 | 65,208 |
| Third N2 discharge (260) | $Nm^3/hr$ | — | — | — | 142,535 | 159,131 |

The invention claimed is:

1. A process for the separation of a compressed feed air stream to produce an oxygen product and optionally a nitrogen product, the process comprising:

providing a multi-column distillation system comprising a lower-pressure column and a higher-pressure column;

passing a first portion of the compressed feed air stream into a first end of a first heat exchanger section, cooling the first portion of the compressed feed air stream in the first heat exchanger section, and withdrawing the first portion of the compressed feed air stream from a second end of the first heat exchanger section passing the first portion of the compressed feed air stream withdrawn from the second end of the first heat exchanger section to at least one of the higher-pressure column or the lower-pressure column;

passing a second portion of the compressed feed air stream into a first end of a second heat exchanger section, cooling the second portion of the compressed feed air stream in the second heat exchanger section, and withdrawing the second portion from a second end of the second heat exchanger section passing the second portion of the compressed feed air stream withdrawn from the second end of the second heat exchanger section to the higher-pressure column;

withdrawing an oxygen-enriched fraction from the higher-pressure column;

passing the oxygen-enriched fraction withdrawn from the higher-pressure column to the lower-pressure column;

withdrawing an oxygen-rich fraction from the lower-pressure column;

passing the oxygen-rich fraction withdrawn from the lower-pressure column to the second end of the first heat exchanger section, heating the oxygen-rich fraction in the first heat exchanger section, and withdrawing the oxygen-rich fraction from the first end of the first heat exchanger section as the oxygen product;

withdrawing a nitrogen-enriched fraction from the higher-pressure column;

passing the nitrogen-enriched fraction withdrawn from the higher-pressure column to the second end of the first heat exchanger section, heating the nitrogen-enriched fraction in the first heat exchanger section, and withdrawing the nitrogen-enriched fraction from a position intermediate the first end and the second end of the first heat exchanger section; and expanding the nitrogen-enriched fraction withdrawn from the position intermediate the first end and the second end of the first heat exchanger section in an expander to produce work and reduce the pressure of the nitrogen-enriched fraction;

withdrawing a nitrogen-rich byproduct from the lower-pressure column;

passing a first fraction of the nitrogen-rich byproduct withdrawn from the lower-pressure column to a first end of a first subcooler heat exchanger section, heating the first fraction of the nitrogen-rich byproduct in the first subcooler heat exchanger section, and withdrawing the first fraction of the nitrogen-rich byproduct from a second end of the first subcooler heat exchanger section;

passing a first portion of the nitrogen-rich byproduct from the second end of the first subcooler heat exchanger section to the second end of the first heat exchanger section, heating the first portion of the nitrogen-rich byproduct in the first heat exchanger section, and withdrawing the first portion of the nitrogen-rich byproduct from the first end of the first heat exchanger section as a first nitrogen-rich discharge byproduct gas;

passing a second portion of the first fraction of the nitrogen-rich byproduct from the second end of the first subcooler heat exchanger section to the second end of the second heat exchanger section, heating the second portion of the first fraction of the nitrogen-rich byproduct in the second heat exchanger section, and withdrawing the second portion of the first fraction of the nitrogen-rich byproduct from the first end of the second heat exchanger section as a third nitrogen-rich discharge product gas;

wherein passing a second fraction of the nitrogen-rich byproduct withdrawn from the lower-pressure column to a first end of a second subcooler heat exchanger section, heating the second fraction of the nitrogen-rich byproduct in the second subcooler heat exchanger section, and withdrawing the second fraction of the nitrogen-rich byproduct from a second end of the second subcooler heat exchanger section;

wherein passing the second fraction of the nitrogen-rich byproduct from the second end of the second subcooler heat exchanger section to the second end of the second heat exchanger section, heating the second fraction of the nitrogen-rich byproduct in the second heat exchanger section, and withdrawing the second fraction of the nitrogen-rich byproduct from the first end of the second heat exchanger section as a second nitrogen-rich discharge byproduct gas;

wherein the expanded nitrogen-enriched fraction or a first portion thereof is passed to the second end of the second heat exchanger section, heated in the second heat exchanger section, and withdrawn from the first end of the second heat exchanger section; and wherein the second portion of the first fraction of the nitrogen-rich byproduct passed to the second end of the second heat exchanger section and the expanded nitrogen-enriched fraction or first portion thereof passed to the second end of the second heat exchanger section are blended at a location that is upstream of the second heat exchanger section and downstream of the first and second subcooler heat exchanger sections and subsequently passed together to the second end of the second heat exchanger section.

2. The process according to claim 1 wherein the pressure of the second portion of the compressed feed air stream is less than the pressure of the first portion of the compressed air feed stream.

3. The process according to claim 1 wherein a higher-pressure heat exchanger comprises the first heat exchanger section; and wherein a lower-pressure heat exchanger comprises the second heat exchanger section, wherein the maximum operating pressure in the lower-pressure heat exchanger is lower than the maximum operating pressure in the higher-pressure heat exchanger.

4. The process according to claim 1 further comprising:

passing a third portion of the compressed feed air stream into the first end of the first heat exchanger section, cooling the third portion of the compressed feed air stream in the first heat exchanger section, and withdrawing the third portion of the compressed air feed stream from a position intermediate the first end and the second end of the first heat exchanger section;

expanding the third portion of the compressed feed air stream withdrawn from the position intermediate the first end and the second end of the first heat exchanger section in a second expander to produce work and reduce the pressure of the third portion of the compressed feed air stream; and passing the third portion after expanding to at least one of the higher-pressure column or the lower-pressure column.

5. The process according to claim 4 wherein the second portion of the compressed feed air stream withdrawn from the second end of the second heat exchanger section and the third portion after expanding are blended prior to each being passed together to the higher-pressure column.

6. The process according to claim 1 wherein a nitrogen product is produced, the process further comprising:

withdrawing a nitrogen-rich fraction from the higher-pressure column;

passing a first portion of the nitrogen-rich fraction to a reboiler-condenser of the multi-column distillation system, condensing the first portion of the nitrogen-rich fraction in the reboiler-condenser, and withdrawing the first portion of the nitrogen-rich fraction from the reboiler-condenser;

passing a part of the first portion of the nitrogen-rich fraction withdrawn from the reboiler-condenser to the second end of the second subcooler heat exchanger section, cooling the part of the first portion of the nitrogen-rich fraction in the second subcooler heat exchanger section, and withdrawing the part of the first portion of the nitrogen-rich fraction from the first end of the second subcooler heat exchanger section;

passing the part of the first portion of the nitrogen-rich fraction withdrawn from the first end of the second subcooler heat exchanger section to the lower-pressure column; and passing a second portion of the nitrogen-rich fraction to the second end of the second heat exchanger section, heating the second portion of the nitrogen-rich fraction in the second heat exchanger section, and withdrawing the second portion of the nitrogen-rich fraction from the first end of the second heat exchanger section as the nitrogen product.

7. The process of claim 1, wherein the second portion of the first fraction of the nitrogen-rich byproduct passed to the second end of the second heat exchanger section and the expanded nitrogen-enriched fraction or first portion thereof passed to the second end of the second heat exchanger section that are blended at the location that is upstream of the second heat exchanger section and downstream of the first and second subcooler heat exchanger sections and subsequently passed together to the second end of the second heat exchanger section is performed such that the first portion of the first fraction of the nitrogen-rich byproduct is not mixed with the expanded nitrogen-enriched fraction or first portion thereof and is not passed through the second heat exchanger section after being output from the first subcooler heat exchanger section.

8. The process of claim 1, wherein the second portion of the first fraction of the nitrogen-rich byproduct passed to the second end of the second heat exchanger section and the expanded nitrogen-enriched fraction or first portion thereof passed to the second end of the second heat exchanger section that are blended at the location that is upstream of the second heat exchanger section and downstream of the first and second subcooler heat exchanger sections and subsequently passed together to the second end of the second heat exchanger section is performed in accordance with a blending process that includes:

blending the expanded nitrogen-enriched fraction with the first fraction of the nitrogen-rich byproduct to form a nitrogen-rich mixture upstream of the first and second heat exchange sections and downstream of the first subcooler heat exchanger section and subsequently splitting the nitrogen-rich mixture such that a first portion of the nitrogen-rich mixture including the first portion of the first fraction of the nitrogen-rich byproduct and a second portion of the expanded nitrogen-enriched fraction is passed to the second end of the first heat exchanger section and a second portion of the nitrogen-rich mixture including the first portion of the first fraction of the nitrogen-rich byproduct and the first portion of the expanded nitrogen-enriched fraction is passed to the second end of the second heat exchanger section.

* * * * *